US007090519B2

(12) United States Patent
Muramatsu et al.

(10) Patent No.: US 7,090,519 B2
(45) Date of Patent: Aug. 15, 2006

(54) CARD CONNECTOR

(75) Inventors: Hidenori Muramatsu, Kanagawa (JP); Satoru Watanabe, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/092,467

(22) Filed: Mar. 29, 2005

(65) Prior Publication Data

US 2005/0215098 A1 Sep. 29, 2005

(30) Foreign Application Priority Data

Mar. 29, 2004 (JP) ..... 2004-097233

(51) Int. Cl.
*H01R 13/62* (2006.01)

(52) U.S. Cl. ..... 439/159; 439/487

(58) Field of Classification Search ..... 439/485, 439/487, 159

See application file for complete search history.

(56) References Cited

U.S. PATENT DOCUMENTS

| | | | | |
|---|---|---|---|---|
| 5,256,080 | A * | 10/1993 | Bright | 439/342 |
| 6,476,484 | B1 * | 11/2002 | Liang | 257/718 |
| 6,547,580 | B1 * | 4/2003 | Leavitt et al. | 439/266 |
| 6,942,506 | B1 * | 9/2005 | Kimura et al. | 439/159 |

FOREIGN PATENT DOCUMENTS

| | | |
|---|---|---|
| JP | 06-151004 | 5/1994 |
| JP | 2001-024370 | 1/2001 |

* cited by examiner

*Primary Examiner*—Truc Nguyen
(74) *Attorney, Agent, or Firm*—Barley Snyder LLC

(57) ABSTRACT

The present invention provides a card connector in which heat dissipation of a card can be performed by means of a heatsink without requiring any operation of the heatsink by the consumer. The card connector comprises a heatsink for contacting one surface of the card that is inserted into a connector part, and a push rod for ejecting the card. The push rod has a cam having a first cam surface which acts so that the heatsink moves away from the one surface of the card at the time of the insertion of the card, and a second cam surface which acts so that the heatsink moves away from the one surface of the card during the ejection of the card.

8 Claims, 16 Drawing Sheets

CARD CONNECTOR

FIELD OF THE INVENTION

The present invention relates to a card connector comprising a connector part into which a card such as a PCMCIA standard PC card is inserted and an ejection mechanism which ejects the card from the connector part.

BACKGROUND OF THE INVENTION

For example, the card connector shown in FIG. 17 (see Japanese Patent Application Kokai No. H6-151004) is known as a conventional card connector of this type.

This card connector 101 is mounted on a circuit board PCB, and comprises a connector part 102 into which a card (not shown in the figure) such as a PCMCIA standard PC card is inserted, and an ejection mechanism 103 which ejects the card from the connector part 102. Furthermore, the ejection mechanism 103 comprises a cam arm 104 which is installed in the connector part 102 so that this cam arm can pivot and which ejects the card from the connector part 102 by pushing the front end (upper end in FIG. 17) of the card that is inserted into the connector part 102 to the rear, and a push rod 105 which is linked with the cam arm 104 and which can move linearly in the forward-rearward direction.

This card connector 101 is devised so that when a card is inserted into the connector part 102, the card and the circuit board PCB are electrically connected via the connector part 102. Furthermore, when the push rod 105 is caused to move forward linearly while the card is inserted in the connector part 102, the cam arm 104 pivots to push the front end of the card I a rearward direction, so that the card is ejected from the connector part 102.

Demand has increased in recent years for the use of the card connector 101 shown in FIG. 17 comprising an ejection mechanism, for example, in a subscriber-system television setup box. In a setup box, there are cases in which a card is connected to the card connector 101 for a long time because of the circumstances of the viewers. When a card is connected to the card connector 101 for a long time, there is a danger that the temperature of the card will be elevated, which will cause operational malfunction. Accordingly, there is a need for dissipating heat.

Methods for dissipating heat of a card include a method in which a card is caused to contact a heatsink, a method in which heat dissipation of a card is performed by means of a heat-dissipating fan, and the like. However, the method that uses a heat-dissipating fan is not suitable for dissipating heat of a card used in a setup box since the sound of the rotating heat-dissipating fan is annoying to the viewers.

Therefore, it is preferable to use a method for dissipating heat of a card by means of the method in which a card is caused to contact a heatsink. However, heat dissipation of the card cannot be performed in the card connector 101 shown in FIG. 17.

Meanwhile, the IC socket shown in FIG. 18 (see Japanese Patent Application Kokai No. 2001-24370) has conventionally been known as a Zero Insertion Force (ZIF) type IC socket in which heat dissipation of an electronic component is performed by means of a heatsink.

This IC socket 201 comprises a housing 202 in which a plurality of socket contacts 203 are arranged in the form of a matrix, a slider 207 which is disposed on the housing 202 so that this slider can move, and a component attachment-detachment operation/pressing member 204 which is provided on the housing 202 so that this member can pivot. The component attachment-detachment operation/pressing member 204 comprises a component attachment-detachment operation lever 205 which is disposed on the housing 202 in a pivotable manner and which causes the slider 205 to move, and a component pressing part 206 which is integrally formed with the component attachment-detachment operation lever part 205 and which presses the upper surface of a heatsink 220 placed on an electronic component 210 that is in the mounted and connected state.

Furthermore, when the component attachment-detachment operation lever 205 is placed in an upright state, i.e., when the slider 207 is in a state in which an electronic component can be mounted, the electronic component 210 is mounted on the slider 207, and the heatsink 220 is placed on this electronic component 210. Afterward, the component attachment-detachment operation lever part 205 is pivoted and engaged with a locking part 208. As a result, the slider 207 moves over the housing 202, and the contacts (not shown in the figure) provided on the electronic component 210 make contact with the socket contacts 203 with a pressure being applied; at the same time, the component pressing part 206 presses the upper surface of the heatsink 220, so that the electronic component 210 and the heatsink 220 are tightly attached. As a result, heat dissipation of the electronic component 210 is possible. Furthermore, when the electronic component 210 is to be removed, it is only necessary to cause the component attachment-detachment operation lever part 205 to pivot and stand, to remove the heatsink 220, and subsequently to remove the electronic component 210.

However, in the IC socket 201 shown in FIG. 18, the worker must operate the heatsink 220 when attaching and detaching the electronic component 201. Accordingly, if this technology is applied to the card connector 101 shown in FIG. 17, for instance, the consumer (viewer) is required to operate the heatsink, besides operating the ejection of the card, so that this IC socket is not suitable for consumer use.

SUMMARY OF THE INVENTION

Accordingly, the present invention was devised in light of the problems described above; it is an object of the present invention to provide a card connector that is capable of dissipating heat of a card by means of a heatsink without requiring any operation of the heatsink by the consumer.

In order to solve the problems described above, a card connector is provided according to an exemplary embodiment of the invention, comprising a connector part into which a card is inserted and an ejection mechanism which ejects the card from this connector part. This ejection mechanism has a cam arm that is provided to the connector part in a pivotable manner and that ejects the card from the connector part, and a push rod that is provided on one side of the connector part and that is linked with the cam arm so that this push rod can move linearly in the forward-rearward direction, the cam arm pivoting to retract the push rod during the insertion of the card, and the cam arm pivoting to eject the card when the push rod advances. This card connector further comprises a heatsink for contacting one surface of the card that is inserted into the connector part, and spring means for driving this heatsink toward the one surface of the card, the push rod has a cam part having a first cam surface which acts so that the heatsink moves away from the one surface of the card at the time of the insertion of the card, and a second cam surface which acts so that the heatsink moves away from the one surface of the card during the ejection of the card.

In the card connector described above, since this card connector comprises a heatsink for contacting one surface of a card that is inserted into the connector part, and spring means for driving this heatsink toward the one surface of the card, heat dissipation of the card can be performed by the heatsink without requiring any operation of the heatsink by the consumer. Furthermore, the push rod has a cam part having a first cam surface which acts so that the heatsink moves away from the one surface of the card at the time of the insertion of the card, and a second cam surface which acts so that the heatsink moves away from the surface of the card during the ejection of the card; accordingly, it is possible to avoid the danger that the card will interfere with the heatsink during the insertion and ejection of the card.

DETAILED DESCRIPTION OF THE EMBODIMENT(S)

Next, embodiments of the present invention will be described with reference to the figures. In FIGS. 1A and 1B, 2A to 2C, 3A and 3B, and 4, the card connector 1 comprises a connector part 10 into which a card C is inserted, and an ejection mechanism 20 which ejects the card C from the connector part 10.

Figure 1A:
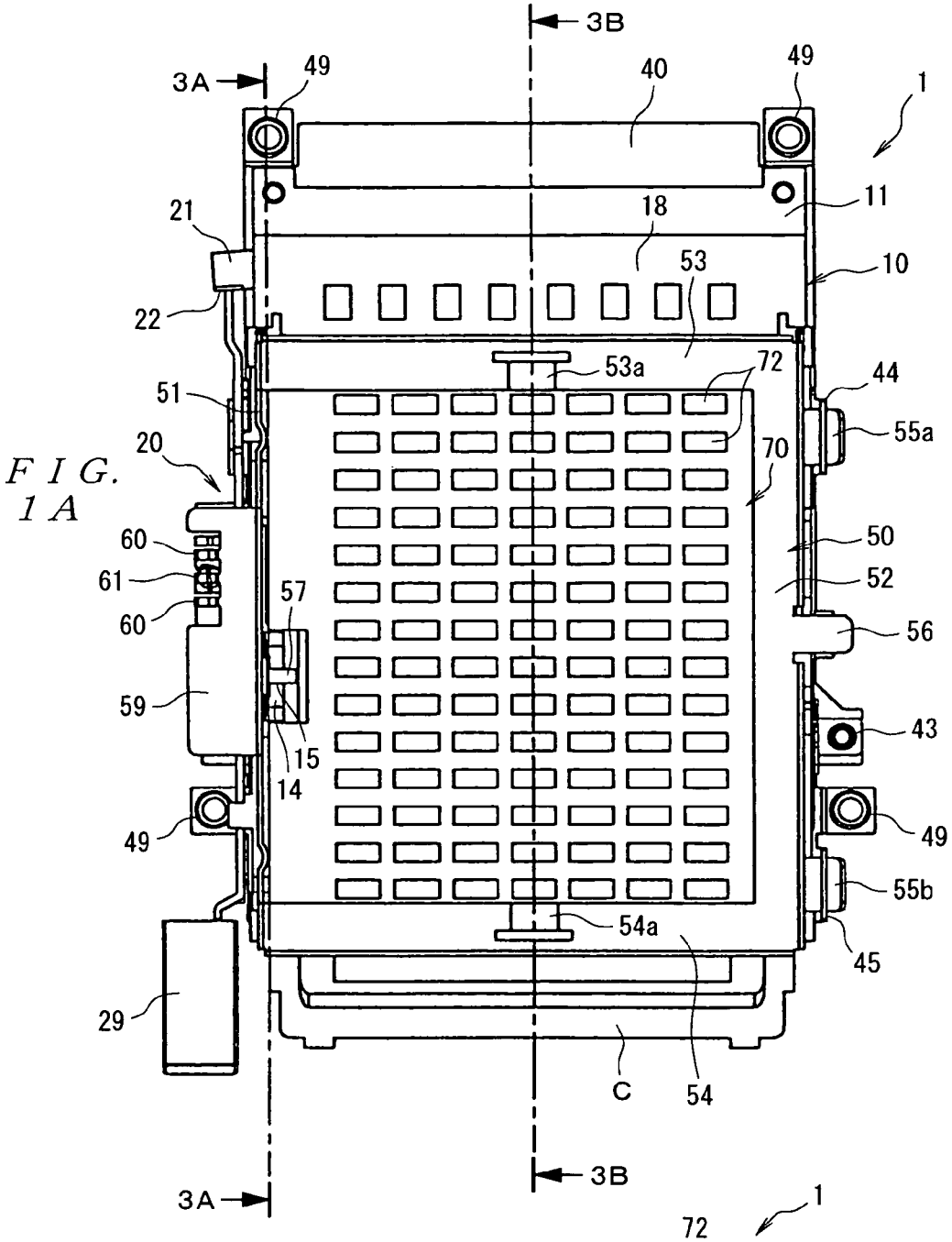
FIGS. 1A and 1B show a card connector according to an exemplary embodiment of the present invention, with FIG. 1A being a plan view, and FIG. 1B being a front view.
Figure 1B:
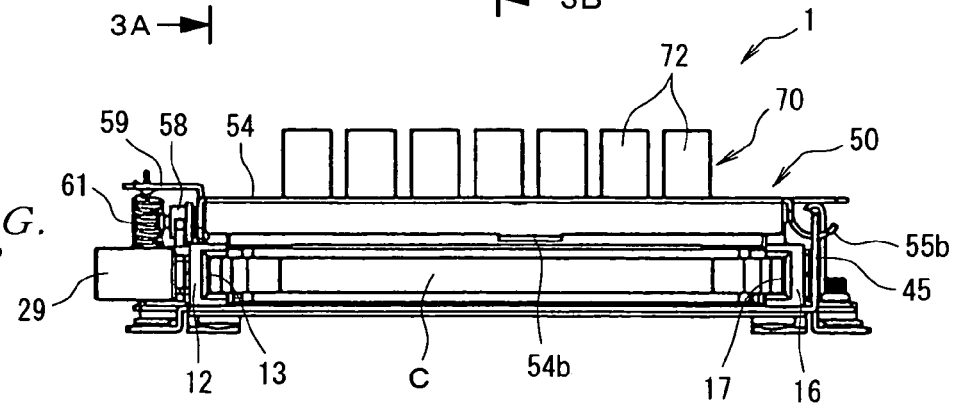
Figure 2A:
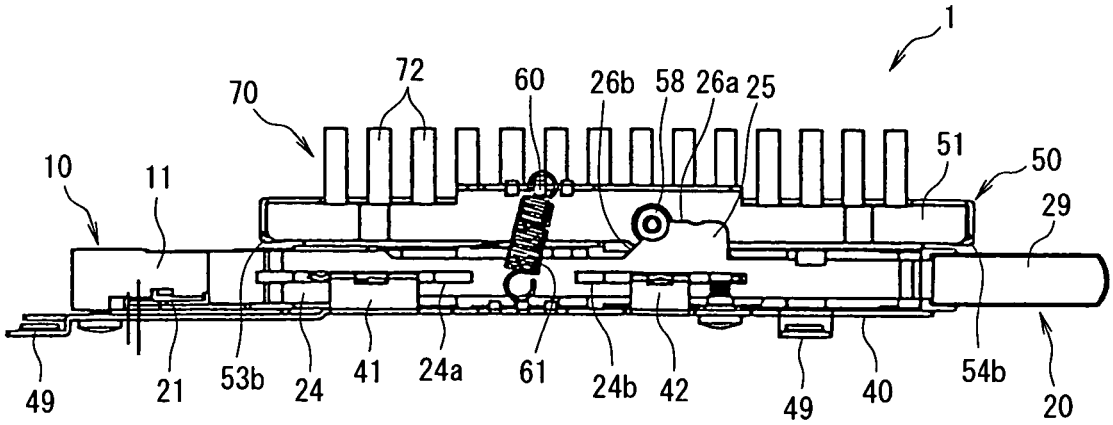
FIGS. 2A to 2C show the card connector shown in FIGS. 1A and 1B, with FIG. 2A being a left-side view, FIG. 2B being a right-side view, and FIG. 2C being a back view.
Figure 2B:
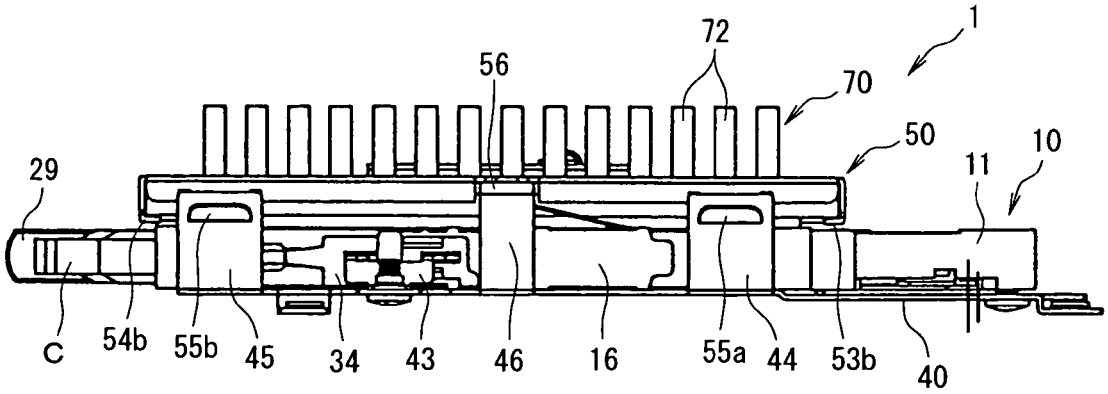
Figure 2C:
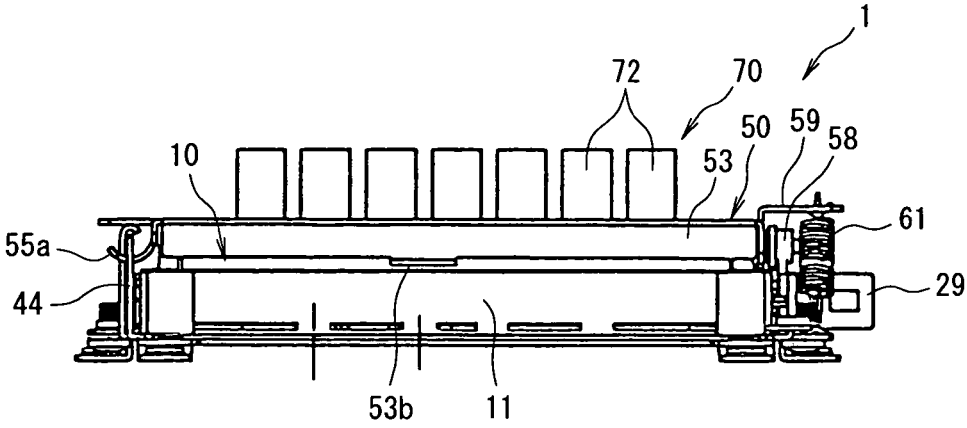
Figure 3A:
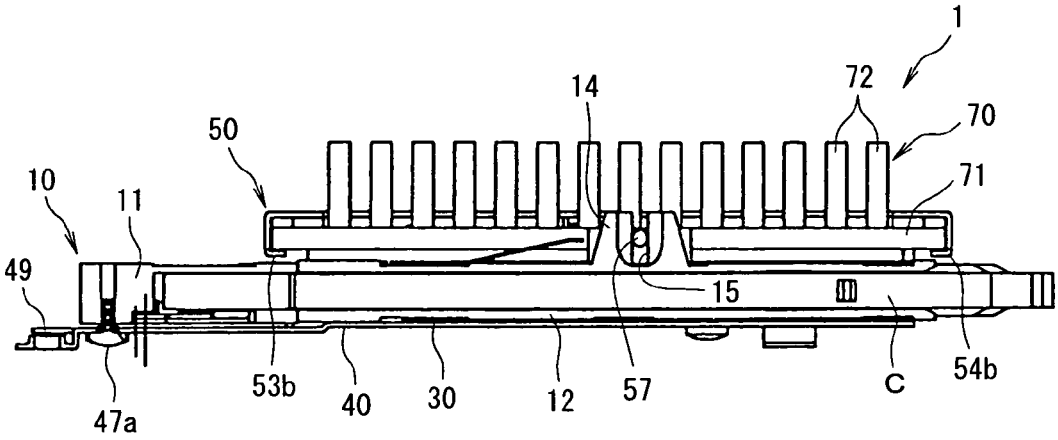
FIGS. 3A and 3B show the card connector shown in FIGS. 1A and 1B, with FIG. 3A being a sectional view along line 3A—3A in FIG. 1A, and FIG. 3B being a sectional view along line 3B—3B in FIG. 1A.
Figure 3B:
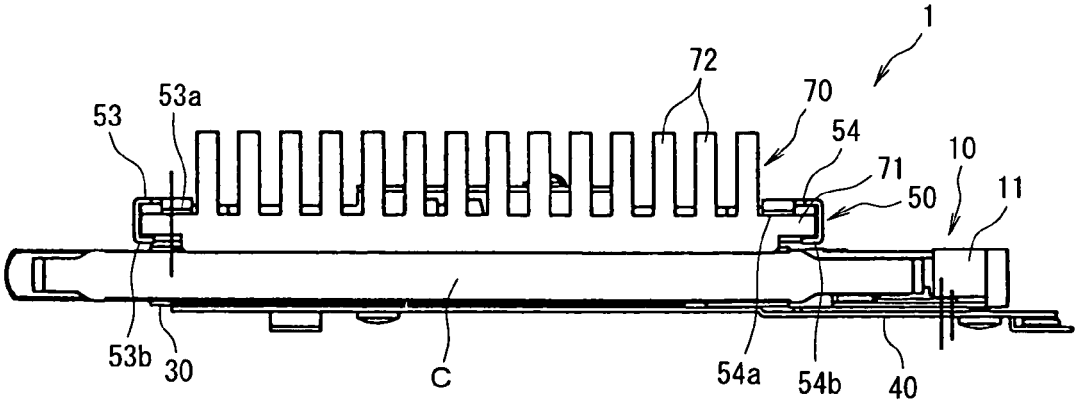
Figure 4:
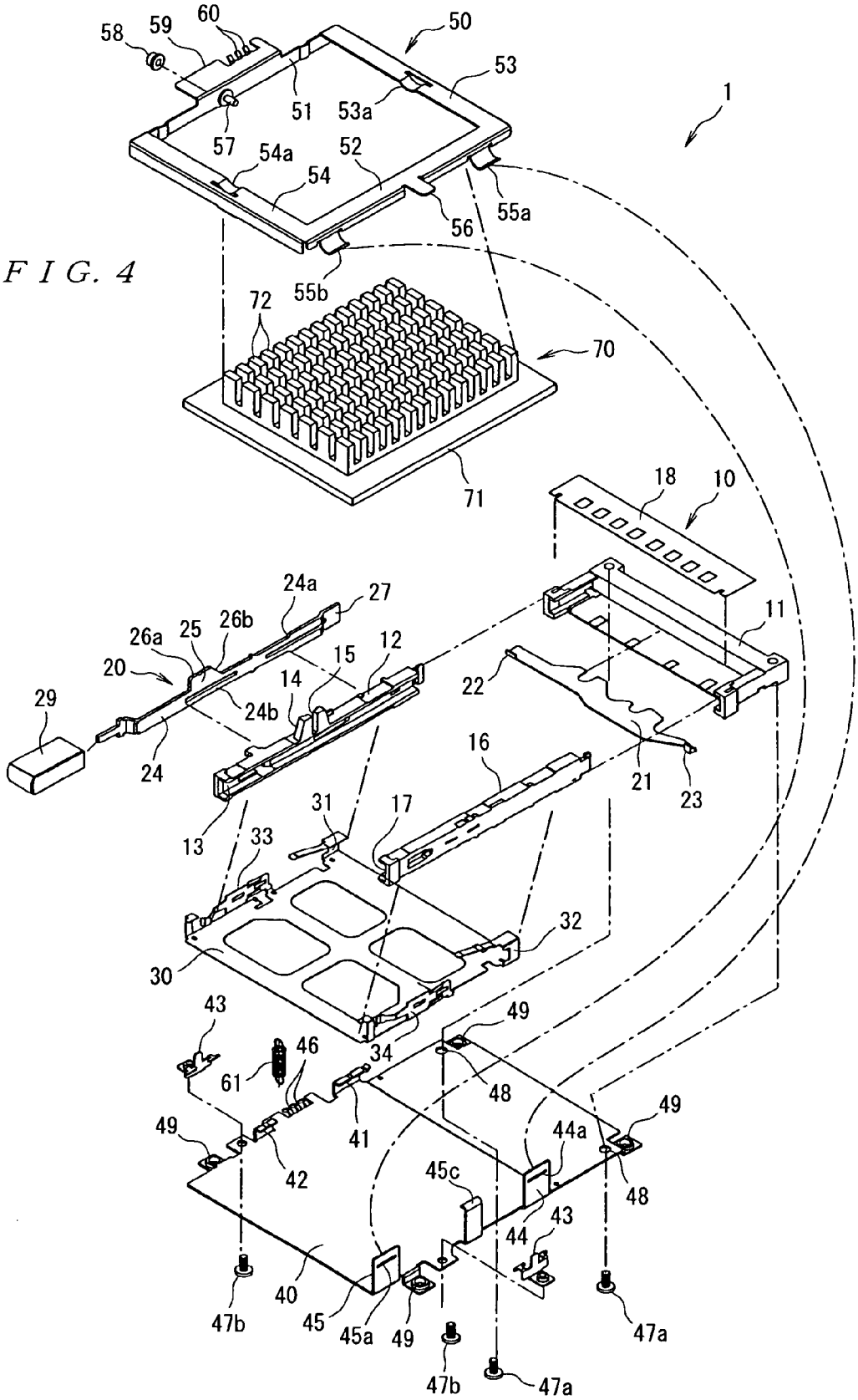
FIG. 4 is an exploded perspective view of the card connector shown in FIG. 1.

The connector part 10 comprises a header 11 into which the card C is inserted and which has a plurality of contacts (not shown in the figures) that are contacted by the contacts (not shown in the figures) of the card C, and a pair of guide arms 12 and 16 which extend rearward (downward in FIG. 1A) from either side portion of the header 11 in the direction of width (left-right direction in FIG. 1A). The respective guide arms 12 and 16 are press-fitted to either side portion of the header 11 in the direction of width in the front end portions of these guide arm parts. Furthermore, a ground plate 18 is disposed on the upper surface of the header 11.

A recessed guide 13 which guides the insertion of the card C is formed on the inside of the guide arm 12 that is located on one side (left side in FIG. 1A) of the header 11 in the direction of width, while a recessed guide 17 which guides the insertion of the card C is also formed on the inside of the guide arm 16 that is located on the opposite side of the header 11 in the direction of width. Furthermore, a protruding part 14 protrudes from the upper surface of the guide arm 12 that is located on the first side described above substantially in the central portion in the forward-rearward direction, and a guide slit 15 that opens on the top is formed in this protruding part 14.

Moreover, a middle frame 30, which may, for example, be made of metal, is attached to the guide arms 12 and 16 so that this middle frame covers the lower portions of the pair of guide arms 12 and 16. Side walls 31 and 32 with a cross-sectional reverse C shape which rise from either side of the middle frame 30 in the direction of width and which are attached to the guide arms 12 and 16 are provided on the front end portions of the middle frame 30 on either side in the direction of width. Furthermore, side walls 33 and 34 which rise from either side of the middle frame 30 in the direction of width and which are positioned on the outside of the guide arms 12 and 16 are provided on either side of the middle frame 30 in the direction of width substantially in the central portion in the forward-rearward direction.

Moreover, a lower frame 40, which may, for example, be made of metal, is installed so that this lower frame covers the lower portions of the header 11 and middle frame 30. A pair of attachment-screw through-holes 48 are formed in the front end of the lower frame 40 on either side in the direction of width, and the lower frame 40 is attached to the header 11 by attachment screws 47*a* via these attachment-screw through-holes 48. Furthermore, a pair of brackets 43 are attached by attachment screws 47*b* to either side of the lower frame 40 in the direction of width substantially in the central portion in the forward-rearward direction. The lower frame 40 is attached to the middle frame 30 by these brackets 43 being attached to the side walls 33 and 34 of the middle frame 30 from the outside. Side wall guides 41 and 42 with a cross-sectional reverse C shape which rise from the lower frame 40 are respectively provided toward the front and toward the rear of the lower frame 40 on one side in the direction of width. Moreover, side wall supports 44 and 45 which rise from the lower frame 40 are respectively provided toward the front and on the rear end of the lower frame 40 on the other side in the direction of width. Slits 44*a* and 45*a* that extend in the forward-rearward direction are formed in the respective side wall supports 44 and 45. Furthermore, a plurality of spring locking parts 46 are provided between the side wall guides 41 and 42 that are located on the first side of the lower frame 40 in the direction of width. Moreover, a stopper 45*c* stands between the supporting side wall parts 44 and 45 that are located on the second side of the lower frame 40 in the direction of width. In addition, two pairs of attachment-screw holes 49 are formed in the front end and rear end of the lower frame 40 on either side in the direction of width, and the lower frame 40 is mounted on a circuit board (not shown in the figures) by screwing attachment screws (not shown in the figures) into these attachment-screw holes 49.

The ejection mechanism 20 comprises a cam arm 21 that is provided to the header 11 in a pivotable manner, and a push rod 24 that is provided on the outside of the guide arm 12 of the connector part 10.

The cam arm 21 is disposed on the header 11 so that this cam arm can pivot, with one end 22 being disposed on the side of the push rod 24 and the other end 23 being disposed on the opposite side. Furthermore, this cam arm 21 is designed to eject the card C from the connector part 10 by pushing the front end portion of the inserted card C with the second end 23 of the cam arm 21.

The push rod 24 has a first slit 24*a* that extends in the forward-rearward direction toward the front thereof and a second slit 24*b* that extends in the forward-rearward direction toward the rear thereof; as a result of these first and second slits 24*a* and 24*b* being guided and supported by the side wall guides 41 and 42 of the lower frame 40, the push rod 24 can move linearly in the forward-rearward direction. The front end 27 of the push rod 24 is linked with the first end 22 of the cam arm 21, so that when the card C is inserted, the cam arm 21 pivots to retract the push rod 24, and when the push rod 24 advances, the cam arm 21 pivots to eject the card C. An operating part 29 is attached to the rear end of the push rod 24. Furthermore, a cam 25 stands on the upper surface of the push rod 24 substantially in the central portion in the forward-rearward direction. This cam 25 has on the upper surface thereof a first cam surface 26*a* which acts so that a heatsink 70 (described later) moves away from the upper surface of the card C at the time of the insertion of the card C; this cam part 25 also has a second cam surface 26*b* which acts so that the heatsink 70 moves away from the surface of the card C during the ejection of the card C. The second cam surface 26*b* is formed by making the front end surface of the cam 25 an inclined surface.

Furthermore, the heatsink 70 which contacts the upper surface of the card C that is inserted into the header 11 is provided above the pair of guide arms 12 and 16. This heatsink 70 is formed as a substantially rectangular body having a plurality of heat-radiating projections 72 on the upper surface, and has a flange 71 around the circumference thereof. A heat conductive sheet 73 (see FIGS. 6A to 6E) is pasted on the undersurface of the heatsink 70. The heatsink 70 is supported by an upper frame 50 that is shaft-supported on the lower frame 40 so that this upper frame 50 can pivot in the vertical direction.

The upper frame 50 is a hollow frame body, and comprises a front frame part 53, a rear frame part 54, a right frame part 52 that connects the right side of the front frame part 53 and the right side of the rear frame part 54 (right side in FIG. 1A), and a left frame part 51 that connects the left side of the front frame part 53 and the left side of the rear frame part 54, with these frame parts having a cross-sectional L shape. Supporting bent parts 53*a* and 54*a* that are bent so as to protrude downward are respectively formed on the upper wall of the front frame part 53 and on the upper wall of the rear frame part 54 in the central portions of these frame parts in the direction of width. Supporting pieces 53*b* and 54*b* (see FIGS. 3A and 3B) that respectively face the supporting bent parts 53*a* and 54*a* are formed on the respective undersurfaces of the front frame part 53 and rear frame part 54 substantially in the central portions of these frame parts in the direction of width. The flange part 71 of the heatsink 70 is disposed between the supporting bent parts 53*a* and 54*a* of the front frame part 53 and rear frame part 54, and the supporting pieces 53*b* and 54*b* of the front frame part 53 and rear frame part 54, so that the heatsink 70 is supported by the upper frame 50 in a pivotable manner in the vertical direction with the supporting bent parts 53*a* and 54*a* as substantial center points. The right frame part 52 of the upper frame 50 is provided with pivoting supporting parts 55*a* and 55*b* which support the upper frame 50 in a pivotable manner by respectively entering the slits 44*a* and 45*a* in the supporting side wall parts 44 and 45 that are provided on the lower frame 40. Furthermore, the left frame part 51 of the upper frame 50 is provided with a tongue part 59 that is bent outward from the upper surface of this left frame part, and a plurality of spring locking parts 60 are provided on this tongue part 59. Moreover, a supporting shaft 57 is fastened to the left frame part 51 of the upper frame 50, and a cam roller 58 is shaft-supported around the outer circumference of this supporting shaft 57 on the outside portion of the left frame part 51 so that this cam roller can rotate.

Figure 6A:
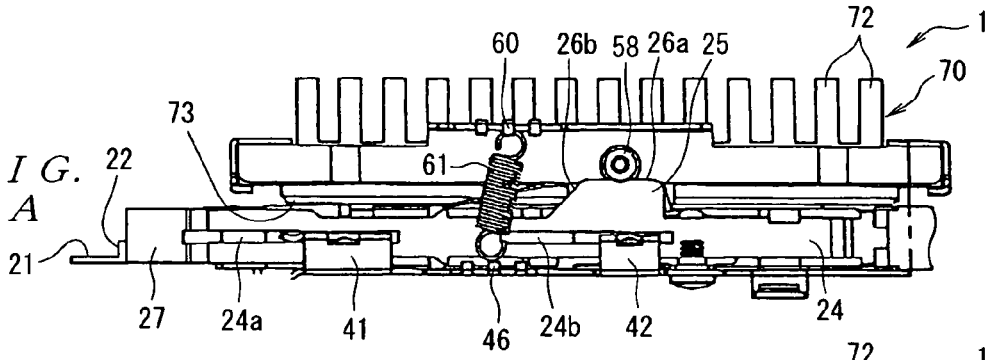
FIGS. 6A to 6E are left-side views of the card connector of FIGS. 1A and 1B showing the relationship between the insertion position of a card with respect to the header, the vertical position of a heatsink with respect to the card, and the position of a push rod in the forward-rearward direction with respect to a cam arm.

Tension springs (spring means) 61 cause the upper frame 50 to pivot downward with the pivoting supporting parts 55*a* and 55*b* as substantial center points. Hook parts of these tension springs 61 are engaged with the spring locking parts 46 of the lower frame 40 and the spring locking parts 60 of the upper frame 50. As a result, the heatsink 70 that is supported by the upper frame 50 also pivots downward. In this case, the downward movement is accomplished by the portion of the supporting shaft 57 on the inside of the upper frame 50 being guided by the guide slit 15 formed in the guide arm 12. Thus, when the card C is inserted in the header 11, the heat conductive sheet 73 on the undersurface of the heatsink 70 contacts the upper surface of the card C. However, when the card C is not inserted in the header 11, as is shown in FIG. 6A, the cam roller 58 is positioned on the first cam surface 26*a* of the cam 25, so that a space for allowing the insertion of the card C is ensured. Furthermore, a stopper piece 56 that protrudes to the outside is formed on the right frame part 52 of the upper frame 50, and as a result of this stopper piece 56 contacting the upper surface of the stopper 45*c* of the lower frame 40, the downward pivoting of the right frame part 52 of the upper frame 50 is restricted.

Next, the actions accompanying the insertion and ejection of the card C will be described with reference to FIGS. 5A to 5E, and 6A to 6E.

Figure 5A:
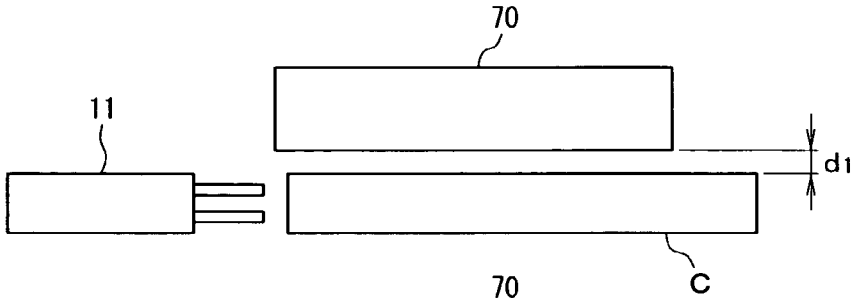
FIGS. 5A to 5E are explanatory diagrams that show in schematic terms the relationship between the insertion position of a card with respect to the header and the vertical position of a heatsink with respect to the card in the card connector shown in FIGS. 1A and 1B.

First, as is shown in FIGS. 5A and 6A, when the card C is not inserted, the push rod 24 is in the most advanced position, and in the position which is such that the front end 27 of the push rod 24 contacts the first end 22 of the cam arm 21, and that the second end 23 of the cam arm 21 is most retracted. In this state, the cam roller 58 is positioned on top of the first cam surface 26*a* of the cam 25, and as is shown in FIG. 5A, a space is ensured which is such that the gap between the upper surface of the card C and the undersurface of the heatsink 70 is $d_1$.

Figure 5B:
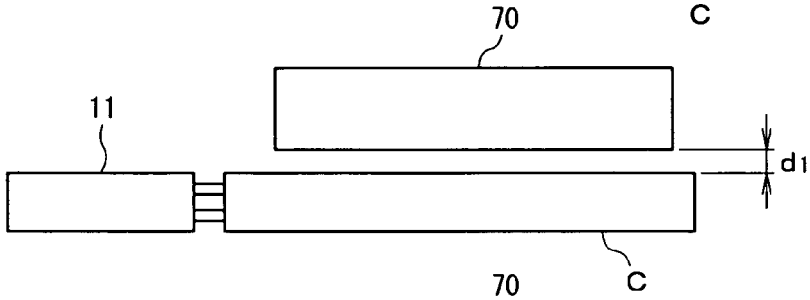
Figure 6B:
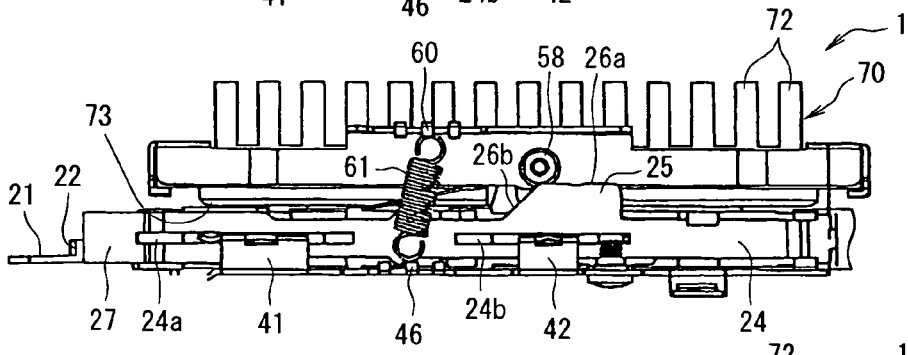

When the card C is inserted into the position to contact the contacts of the header 11 as shown in FIG. 5B, the front end of the card C pushes the second end 23 of the cam arm 21, so that the cam arm 21 pivots to retract the push rod 24 slightly as shown in FIG. 6B. At this point, the cam roller 58 is still located on the first cam surface 26*a* of the cam 25, so that the gap between the upper surface of the card C and the undersurface of the heatsink 70 is still $d_1$ as shown in FIG. 5B. Accordingly, the card C does not interfere with the heatsink 70, so that the insertion of the card C is not hindered. Consequently, the heat conductive sheet 73 provided on the undersurface of the heatsink 70 does not come off during the insertion of the card C.

Figure 5C:
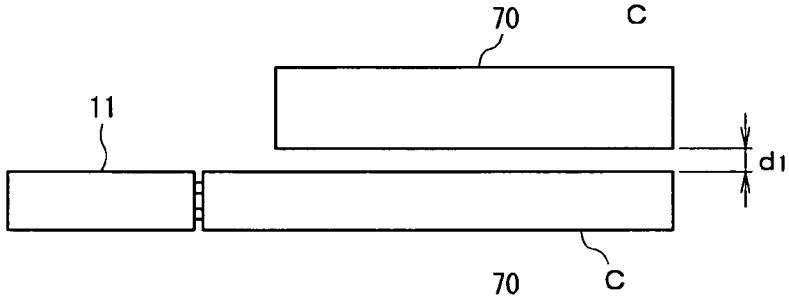
Figure 6C:
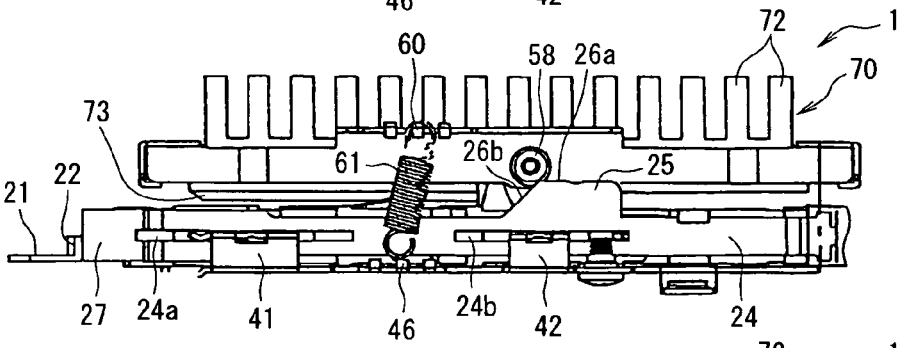

Next, when the card C is inserted into a position just in front of the header 11 as shown in FIG. 5C, the front end of the card C further pushes the second end 23 of the cam arm 21, so that the cam arm 21 pivots to retract the push rod 24 further as shown in FIG. 6C. At this point, the cam roller 58 is located at the boundary position between the first cam surface 26*a* and the second cam surface 26*b* of the cam 25, and as is shown in FIG. 5C, the gap between the upper surface of the card C and the undersurface of the heatsink 70 is still $d_1$. Accordingly, the card C does not interfere with the heatsink 70, so that the insertion of the card C is not hindered. Consequently, the heat conductive sheet 73 provided on the undersurface of the heatsink 70 does not come off during the insertion of the card C.

Figure 5D:
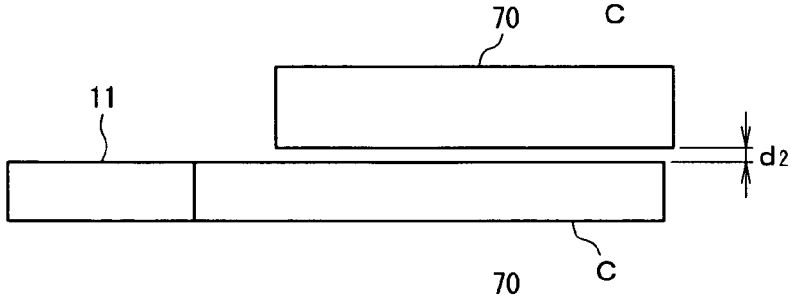
Figure 6D:
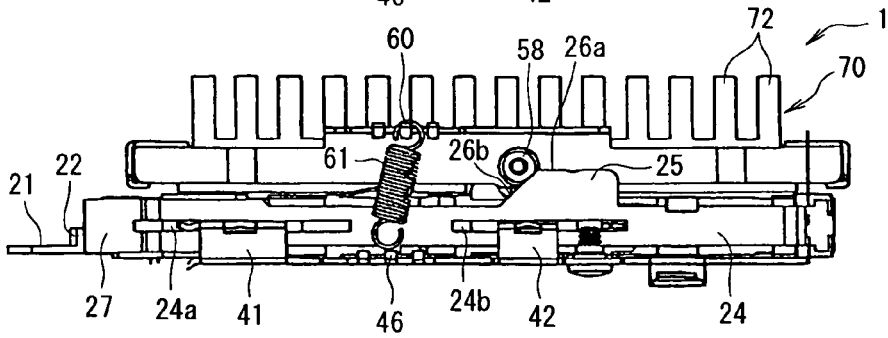

Then, when the card C is completely inserted into the header 11 as shown in FIG. 5D, the front end of the card C further pushes the second end 23 of the cam arm 21, so that the cam arm 21 pivots to retract the push rod 24 further as shown in FIG. 6D. At this point, the cam roller 58 is located in a position on the cam 25 toward the upper portion of the second cam surface 26*b* and engages, so that the gap between the upper surface of the card C and the undersurface of the heatsink 70 is slightly reduced to become $d_2$ as shown in FIG. 5D.

Figure 5E:
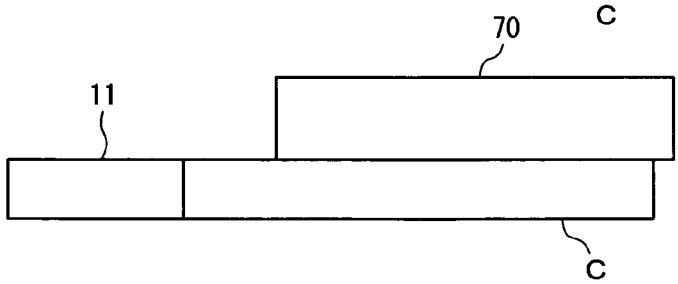
Figure 6E:
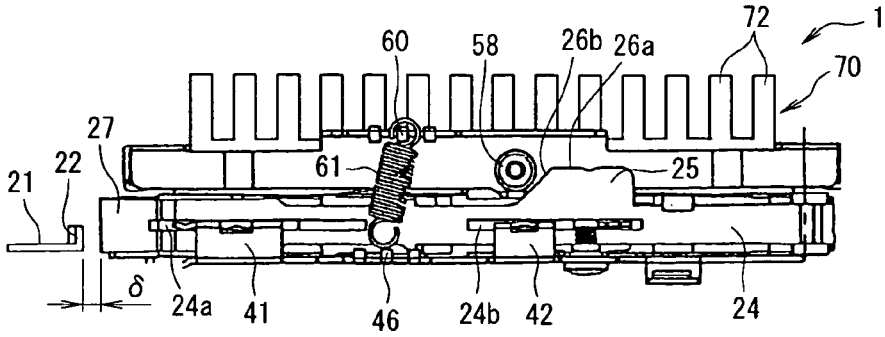
Figure 7:
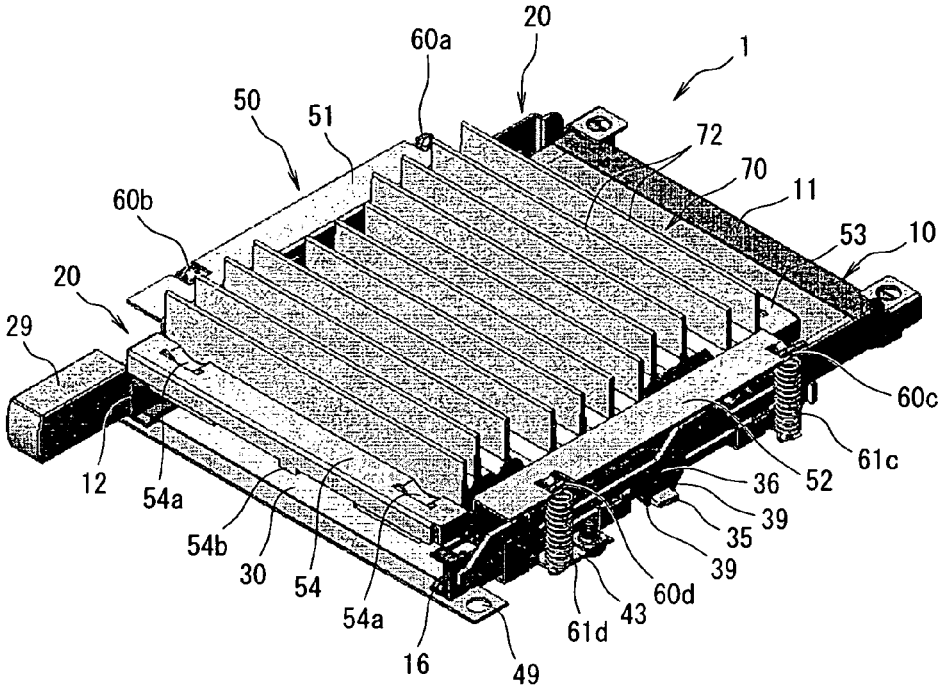
FIG. 7 is a perspective view of a card connector according to another exemplary embodiment of the present invention.

Afterward, as is shown in FIG. 6E, the upper frame 50 and heatsink 70 pivot downward by means of the actions of the tension springs 61, and only the push rod 24 retracts via the second cam surface 26*b* with the lowering of the cam roller 58. Therefore, the undersurface of the heatsink 70, or more accurately, the undersurface of the heat conductive sheet 73 pasted on the undersurface of the heatsink 70, contacts the surface of the card C as shown in FIG. 5E. As a result, heat dissipation of the card C can be performed. Consequently, it is possible to dissipate heat of the card C by means of the heatsink 70 without requiring any operation of the heatsink by the consumer.

Furthermore, since only the push rod 24 retracts, a play □ is created between the front end 27 of the push rod 24 and the first end 22 of the cam arm 21 as shown in FIG. 6E. Accordingly, heat dissipation of the card C can be performed by the heatsink 70 only following the completion of the insertion of the card C into the header 11.

On the other hand, when the inserted card C is to be ejected, the push rod 24 is caused to advance from the state shown in FIG. 6E. Then, the cam roller 58 is raised along the second cam surface 26*b* of the push rod 24, so that the upper frame 50 and heatsink 70 pivot upward. When the push rod 24 is pushed in until the front end 27 of this push rod 24 contacts the first end 22 of the cam arm 21 as shown in FIG. 6D, the gap between the upper surface of the card C and the undersurface of the heatsink 70 (or more accurately, the undersurface of the heat conductive sheet 73 provided on the undersurface of the heatsink 70) becomes $d_2$ as shown in FIG. 5D. In the process from the state shown in FIG. 6E to the state shown in FIG. 6D, since the play □ is present between the front end 27 of the push rod 24 and the first end 22 of the cam arm 21 in the state shown in FIG. 6E, the front end 27 of the push rod 24 does not contact the first end 22 of the cam arm 21. Therefore, the heatsink 70 does not move away from the upper surface of the card C.

Then, when the push rod 24 is caused to advance from the state shown in FIG. 6D to the state shown in FIG. 6C, the front end 27 of the push rod 24 pushes the first end 22 of the cam arm 21, so that the cam arm 21 pivots to retract the front end of the card C to a position just in front of the header 11 as shown in FIG. 5C. At this point, the cam roller 58 is raised along the second cam surface 26*b* of the push rod 24 and located at the boundary position between the first cam surface 26*a* and the second cam surface 26*b*. As a result, as is shown in FIG. 5C, the gap between the upper surface of the card C and the undersurface of the heatsink 70 is increased to $d_1$. Accordingly, the card C does not interfere with the heatsink 70, so that the ejection of the card C is not hindered. Consequently, the heat conductive sheet 73 provided on the undersurface of the heatsink 70 does not come off during the ejection of the card C.

Then, when the push rod 24 is caused to advance from the state shown in FIG. 6C to the state shown in FIG. 6B, the front end 27 of the push rod 24 further pushes the first end 22 of the cam arm 21, so that the cam arm 21 pivots to retract the front end of the card C to a position where this front end contacts the tip ends of the contacts of the header 11 as shown in FIG. 5B. At this point, the cam roller 58 is positioned on the first cam surface 26*a* of the cam 25, and the gap between the upper surface of the card C and the undersurface of the heatsink 70 is maintained at $d_1$ as shown in FIG. 5B. Accordingly, the card C does not interfere with the heatsink 70, so that the ejection of the card C is not hindered. Consequently, the heat conductive sheet 73 provided on the undersurface of the heatsink 70 does not come off during the ejection of the card C.

Then, when the push rod 24 is caused to advance from the state shown in FIG. 6B to the state shown in FIG. 6A, the push rod 24 assumes the most advanced position, and the front end 27 of the push rod 24 further pushes the first end 22 of the cam arm 21, so that the cam arm 21 pivots to retract the front end of the card C to a position where this front end is completely separated from the tip ends of the contacts of the header 11 as shown in FIG. 5A, thus ejecting the card C. In this state, the cam roller 58 is positioned on the first cam surface 26*a* of the cam 25, and the gap between the upper surface of the card C and the undersurface of the heatsink 70 is maintained at d, as shown in FIG. 5A. Accordingly, the card C does not interfere with the heatsink 70, so that the ejection of the card C is not hindered. Consequently, the heat conductive sheet 73 provided on the undersurface of the heatsink 70 does not come off during the ejection of the card C. Furthermore, it is not necessary for the consumer to perform any heatsink removal operation when ejecting the card C.

Here, the heatsink 70 is supported by the upper frame 50 that is shaft-supported by the lower frame 40 so that the upper frame can pivot upward and downward. Accordingly, it is possible to effectively cause the heatsink 70 to move away from the upper surface of the card C with a small number of parts.

Furthermore, the heatsink 70 is supported by the upper frame 50 so that this heatsink can pivot in the vertical direction, it is possible to effectively cause the heatsink 70 to move away from the upper surface of the card C with a small number of parts and with a simple construction.

Next, a second embodiment of the card connector of the present invention will be described with reference to FIGS. 7, 8, 9A and 9B, 10A and 10B, and 11A and 11B. In FIGS. 7, 8, 9A and 9B, 10A and 10B, and 11A and 11B, the card connector 1 comprises a connector part 10 into which a card C is inserted, and an ejection mechanism 20 which ejects the card C from the connector part 10.

Figure 9B:
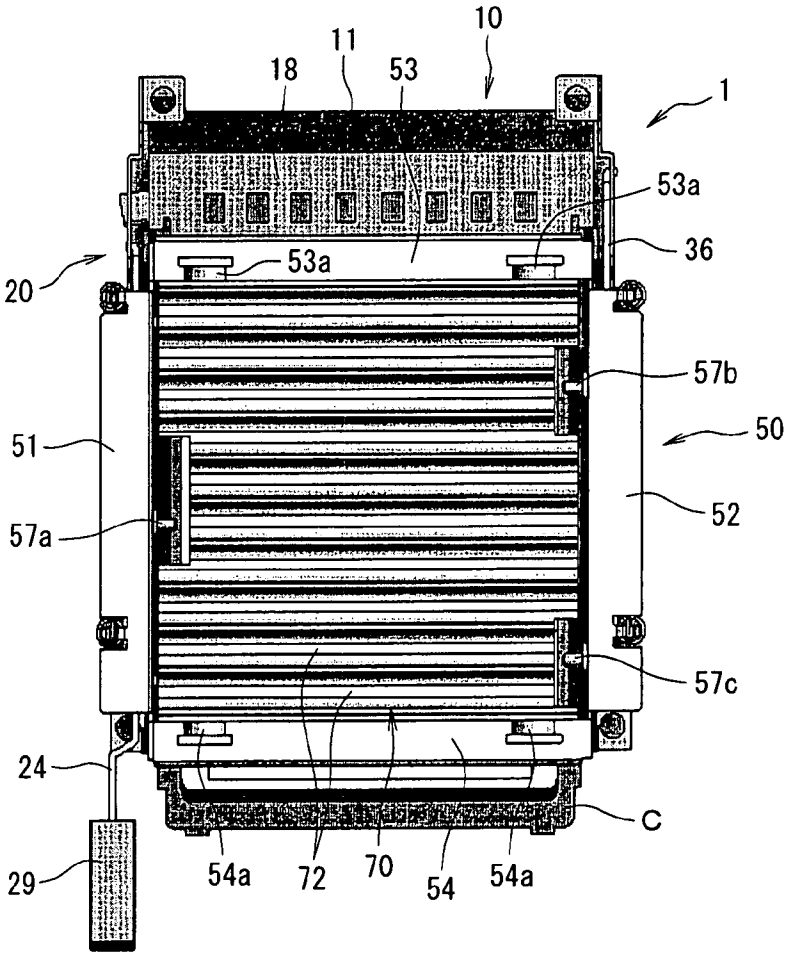
FIGS. 9A and 9B shows plan views of the card connector shown in FIG. 7, with FIG. 9A being a plan view prior to the insertion of the card into the header, and FIG. 9B being a plan view following the insertion of the card into the header.
Figure 9A:
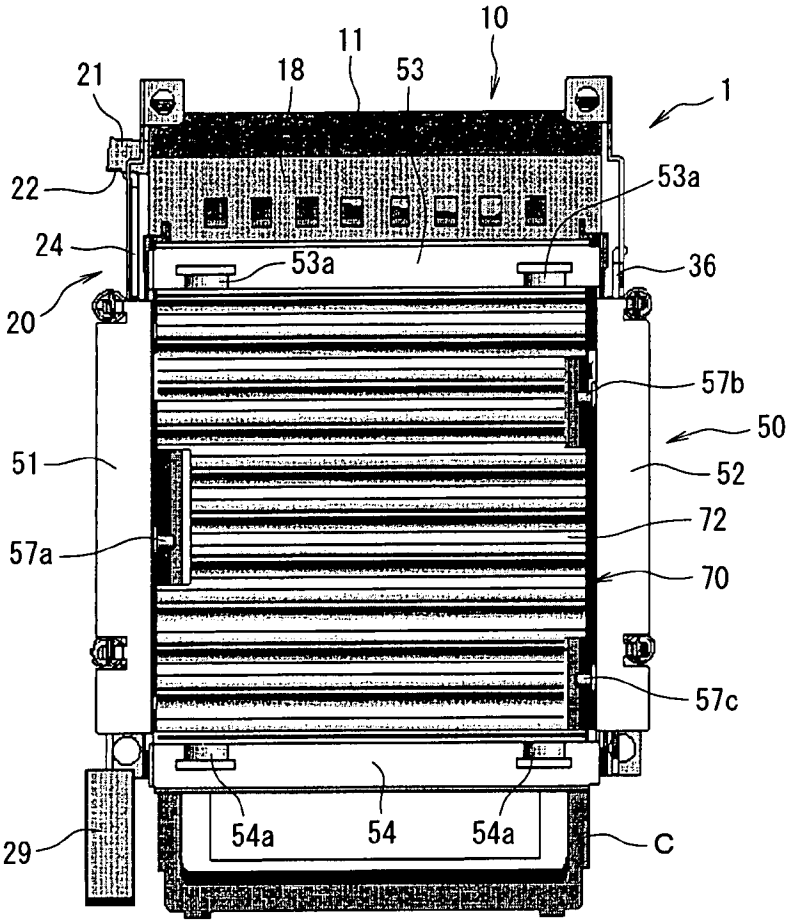

The connector part 10 comprises a header 11 into which the card C is inserted and which has a plurality of contacts (not shown in the figures) that are contacted by the contacts (not shown in the figures) of the card C, and a pair of guide arms 12 and 16 which extend rearward (downward in FIG. 9A) from either side portion of the header 11 in the direction of width (left-right direction in FIG. 9A). The respective guide arms 12 and 16 are press-fitted to either side portion of the header 11 in the direction of width in the front end portions of these guide arms. Furthermore, a ground plate 18 is disposed on the upper surface of the header 11.

Figure 8:
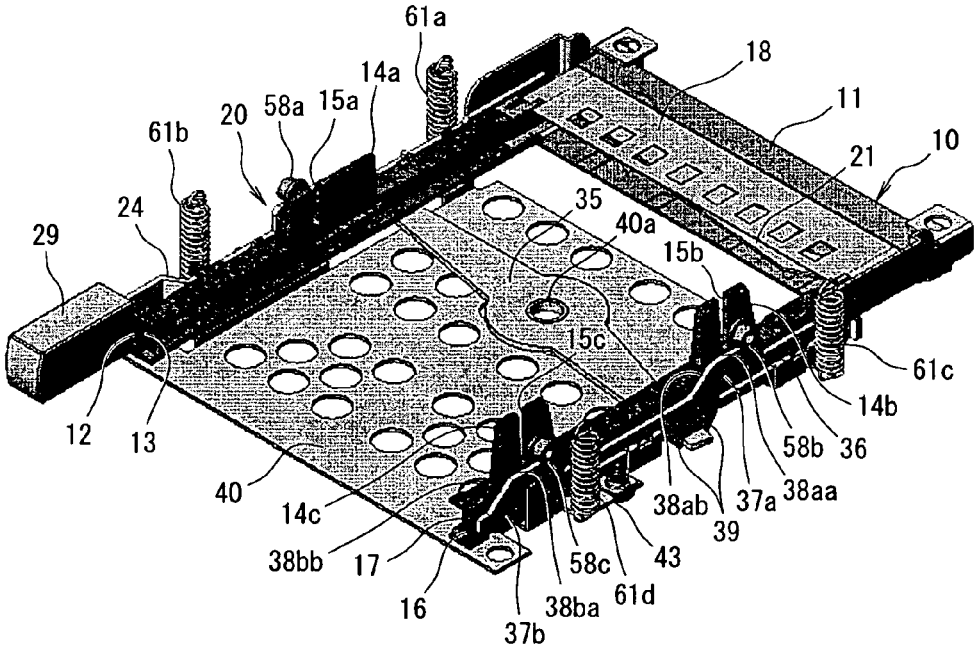
FIG. 8 is a perspective view of the card connector shown in FIG. 7, with the heatsink, upper frame, and middle frame omitted.

As is shown in FIG. 8, a recessed guide 13 which guides the insertion of the card C is formed on the inside of the guide arm 12 that is located on one side (left side in FIG. 9A) of the header 11 in the direction of width, while a recessed guide 17 which guides the insertion of the card C is also formed on the inside of the guide arm 16 that is located on the opposite side of the header 11 in the direction of width. Furthermore, a protruding part 14*a* protrudes from the upper surface of the guide arm 12 that is located on the first side described above substantially in the central portion in the forward-rearward direction, and a guide slit 15*a* that opens on the top is formed in this protruding part 14*a*. In addition, unlike the card connector 1 shown in FIGS. 1A and 1B, protruding parts 14*b* and 14*c* also protrude from the upper surface of the opposite-side guide arm 16 toward the front and toward the rear of this guide arm 16, and guide slits 15*b* and 15*c* that open on the top are respectively formed in these protruding part 14*b* and 14*c*.

Moreover, a middle frame 30, which may, for example, be made of metal, is attached to the guide arms 12 and 16 so that this middle frame covers the lower portions of the pair of guide arms 12 and 16.

In addition, a lower frame 40, which may, for example, be made of metal, is installed so that this lower frame covers the lower portions of the header 11 and middle frame 30. A pair of brackets 43 are attached by attachment screws to either side of the lower frame 40 in the direction of width substantially in the central portion in the forward-rearward direction. Furthermore, side wall guides 41*a* and 42*a* with a cross-sectional reverse C shape which rise from the lower frame 40 are respectively provided toward the front and toward the rear of the lower frame 40 on one side in the direction of width. Moreover, side wall guides 41*b* and 42*b* with a cross-sectional reverse C shape which rise from the lower frame 40 are also respectively provided toward the front and toward the rear end of the lower frame 40 on the other side in the direction of width. Furthermore, spring locking parts 46*a* and 46*b* are respectively provided in the vicinity of the side wall guides 41*a* and 42*a* that are located on the first side of the lower frame 40 in the direction of width, and spring locking parts 46*c* and 46*d* are respectively provided in the vicinity of the guiding side wall parts 41*b* and 42*b* that are located on the opposite side of the lower frame 40 in the direction of width. The lower frame 40 is mounted on a circuit board (not shown in the figures).

Furthermore, the ejection mechanism 20 comprises a cam arm 21 that is provided to the header 11 in a pivotable manner, and a push rod 24 that is provided on the outside of the guide arm 12 of the connector part 10.

The cam arm 21 is disposed on the header 11 so that this cam arm can pivot, with one end 22 being disposed on the side of the push rod 24 and the other end being disposed on the opposite side. Furthermore, this cam arm 21 is designed to eject the card C from the connector part 10 by pushing the front end portion of the inserted card C with the second end of the cam arm 21.

The push rod 24 has a first slit 24*a* that extends in the forward-rearward direction toward the front thereof and a second slit 24*b* that extends in the forward-rearward direction toward the rear thereof; as a result of these first and second slits 24*a* and 24*b* being guided and supported by the side wall guides 41*a* and 42*a* of the lower frame 40, the push rod 24 can move linearly in the forward-rearward direction. The front end 27 of the push rod 24 is linked with the first end 22 of the cam arm 21, so that when the card C is inserted, the cam arm 21 pivots to retract the push rod 24, and when the push rod 24 advances, the cam arm 21 pivots to eject the card C. An operating part 29 is attached to the rear end of the push rod 24. Furthermore, a cam 25 stands on the upper surface of the push rod 24 substantially in the central portion in the forward-rearward direction. This cam 25 has on the upper surface thereof a first cam surface 26*a* which acts so that a heatsink 70 (described later) moves away from the upper surface of the card C at the time of the insertion of the card C; this cam part 25 also has a second cam surface 26*b* which acts so that the heatsink 70 moves away from the surface of the card C during the ejection of the card C. The second cam surface 26*b* is formed by making the front end surface of the cam 25 an inclined surface.

Furthermore, as is shown in FIG. 8, a second rod 36 that can move linearly in the forward-rearward direction is provided on the side of the connector part 10 opposite from the side on which the push rod 24 is provided, i.e., on the outside of the guide arm 16. The second rod 36 has a first slit that extends in the forward-rearward direction toward the front thereof and a second slit that extends in the forward-rearward direction toward the rear thereof; as a result of these first and second slits being respectively guided and supported by side wall guides (not shown) of the lower frame 40, the second rod 36 can move linearly in the forward-rearward direction. Furthermore, second cams 37*a* and 37*b* stand on the upper surface of the second rod 36 toward the front and toward the rear of this second rod, respectively. These second cams 37*a* and 37*b* respectively have on the upper surfaces thereof first cam surfaces 38*aa* and 38*ba* which act so that the heatsink 70 (described later) moves away from the upper surface of the card C at the time of the insertion of the card C; these second cams 37*a* and 37*b* also respectively have second cam surfaces 38*ab* and 38*bb* which act so that the heatsink 70 moves away from the surface of the card C during the ejection of the card C. The second cam surfaces 38*ab* and 38*bb* are respectively formed by making the rear end surfaces of the second cam parts 37*a* and 37*b* inclined surfaces.

Moreover, the push rod 24 and second rod 36 are connected by a link 35. The link 35 is disposed so that this link can pivot with a boss part 40*a* formed substantially in the central portion of the lower frame 40 in the direction of width as the center, with one end being locked and fastened by locking parts 28 of the push rod 24, while the other end is locked and fastened by locking parts 39 of the second rod 36. Accordingly, when the push rod 24 advances, the link 35 pivots to move the first end of the link 35 forward and the second end rearward, thus retracting the second rod 36. Conversely, when the push rod 24 retracts, the link 35 pivots to move the first end of the link 35 rearward and the second end forward, thus advancing the second rod 36.

Furthermore, the heatsink 70 which contacts the upper surface of the card C that is inserted into the header 11 is provided above the pair of guide arms 12 and 16. This heatsink 70 is formed as a substantially rectangular body having a plurality of heat-radiating projections 72 on the upper surface, and has a flange (not shown in the figures) around the circumference thereof. A heat conductive sheet 73 is pasted on the undersurface of the heatsink 70. The heatsink 70 is supported by an upper frame 50.

The upper frame 50 is a hollow frame body, and comprises a front frame part 53, a rear frame part 54, a right frame part 52 that connects the right side of the front frame part 53 and the right side of the rear frame part 54 (right side in FIG. 9A), and a left frame part 51 that connects the left side of the front frame part 53 and the left side of the rear frame part 54, with these frame parts having a cross-sectional L shape. Each pair of supporting bent parts 53*a*, 53*a* and 54*a*, 54*a* that are bent so as to protrude downward is formed on the upper wall of the front frame part 53 and on the upper wall of the rear frame part 54 on either side of these frame parts in the direction of width. Supporting pieces are formed on the respective undersurfaces of the front frame part 53 and rear frame part 54 substantially in the central portions of these frame parts in the direction of width. The flange part of the heatsink 70 is disposed between the supporting bent parts 53*a*, 53*a* and 54*a*, 54*a* of the front frame part 53 and rear frame part 54, and the supporting pieces of the front frame part 53 and rear frame part 54, so that the heatsink 70 is supported by the upper frame 50. Furthermore, a pair of spring locking parts 60*a* and 60*b* are provided toward the front and toward the rear of the left frame part 51 of the upper frame 50, and a pair of spring locking parts 60*c* and 60*d* are provided toward the front and toward the rear of the right frame part 52. Moreover, a supporting shaft 57*a* is fastened to the left frame part 51 of the upper frame 50, and a cam roller 58*a* is shaft-supported around the outer circumference of this supporting shaft 57*a* on the outside portion of the left frame part 51 so that this cam roller 58*a* can rotate. In addition, supporting shafts 57*b* and 57*c* are fastened to the right frame part 52 of the upper frame 50 toward the front and toward the rear of this right frame part, and cam rollers 58*b* and 58*c* are shaft-supported around the respective outer circumferences of these supporting shafts 57*b* and 57*c* on the outside portion of the right frame part 52 so that these cam rollers 58*b* and 58*c* can rotate.

Furthermore, hook parts of tension springs 61*a* and 61*b* that drive the upper frame 50 downward are respectively engaged with the spring locking parts 46*a* and 46*b* of the lower frame 40 and the spring locking parts 60*a* and 60*b* of the upper frame 50, while the hook parts of tension springs 61*c* and 61*d* that drive the upper frame 50 downward are engaged with the spring locking parts 46*c* and 46*d* of the lower frame 40 and the spring locking parts 60*c* and 60*d* of the upper frame 50. As a result, the heatsink 70 that is supported by the upper frame 50 is also driven downward. In this case, the downward movement is accomplished by the portion of the supporting shaft 57*a* on the inside of the upper frame 50 being guided by the guide slit 15*a* formed in the guide arm part 12, and the downward movement is also accomplished by the portions of the supporting shafts 57*b* and 57*c* on the inside of the upper frame 50 being respectively guided by the guide slits 15*b* and 15*c* formed in the guide arm part 16. Thus, when the card C is inserted in the header 11, the heat conductive sheet 73 on the undersurface of the heatsink 70 contacts the upper surface of the card C. However, when the card C is not inserted in the header 11, the cam roller 58*a* is positioned on the first cam surface 26*a* of the cam 25 as shown in FIG. 10A, and the cam rollers 58*b* and 58*c* are respectively positioned on the first cam surfaces 38*aa* and 38*ba* of the second cam 37*a* and 37*b* as shown in FIG. 11A, so that a space for allowing the insertion of the card C is assured.

Next, the actions accompanying the insertion and ejection of the card C will be described with reference to FIGS. 10A and 10B, and 11A and 11B.

Figure 10A:
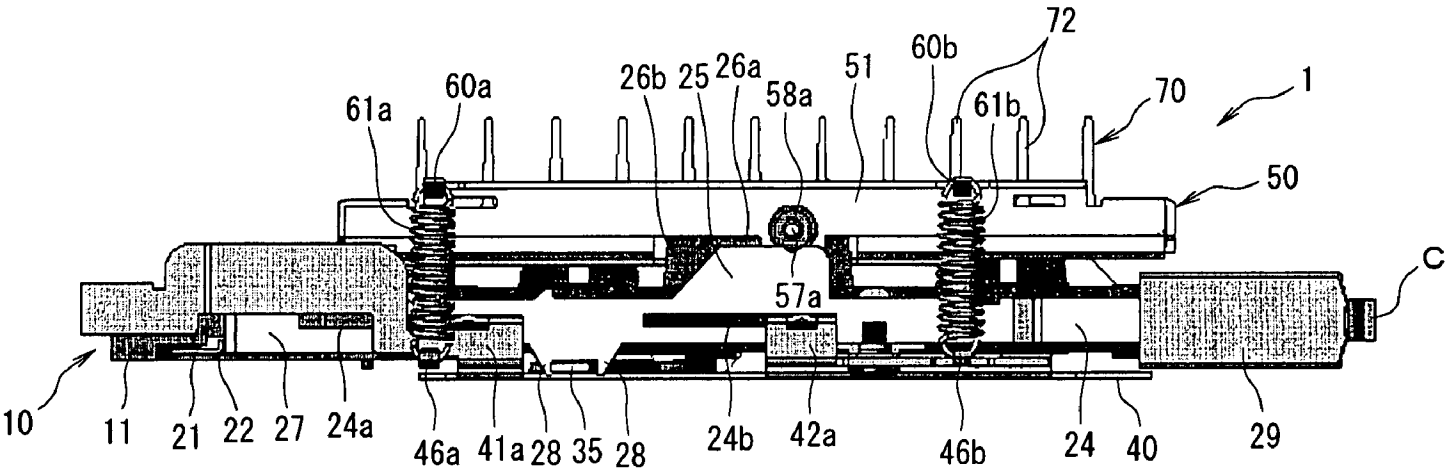
FIGS. 10A and 10B show left-side views of the card connector shown in FIG. 7, with FIG. 10A being a left-side view prior to the insertion of the card into the header, and FIG. 10B being a left-side view following the insertion of the card into the header.
Figure 11A:
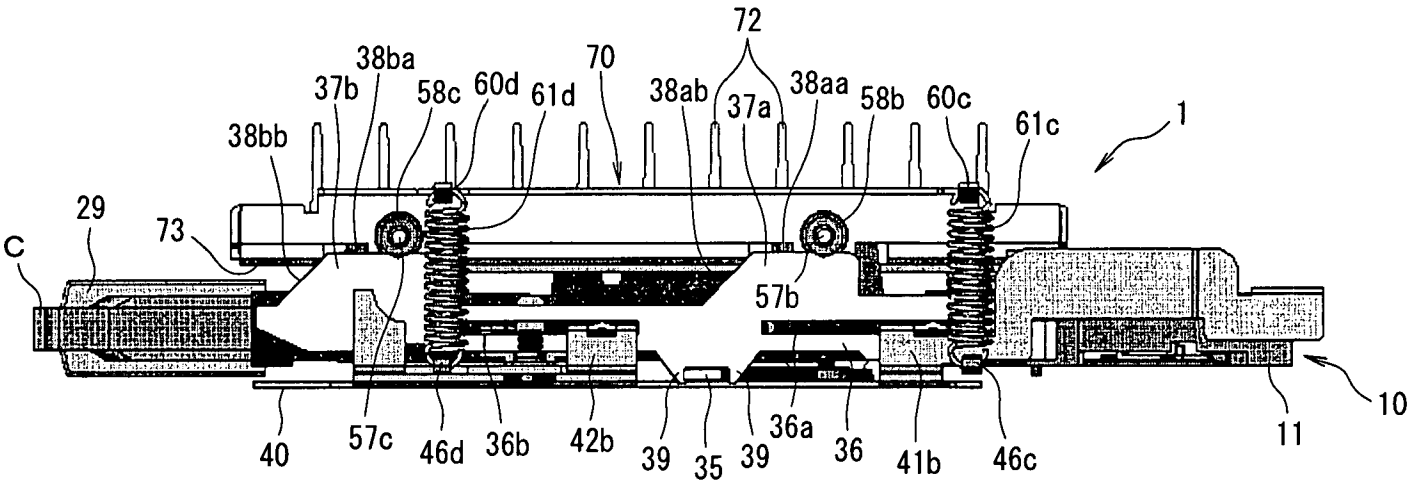
FIGS. 11A and 11B show right-side views of the card connector shown in FIG. 7, with FIG. 11A being a right-side view prior to the insertion of the card into the header, and FIG. 11B being a right-side view following the insertion of the card into the header.

First, as is shown in FIG. 10A, when the card C is not inserted in the header 11, the push rod 24 is in the most advanced position, and in the position which is such that the front end 27 of the push rod 24 contacts the first end 22 of the cam arm 21, and that the second end of the cam arm 21 is most retracted. On the other hand, as is shown in FIG. 11A, the second rod 36 is in the most retracted position. In this state, the cam roller 58*a* is positioned on top of the first cam surface 26*a* of the cam 25, and the cam rollers 58*b* and 58*c* are positioned on top of the first cam surfaces 38*aa* and 38*ba* of the second cams 37*a* and 37*b*, so that a space is ensured which is such that the gap between the upper surface of the card C and the undersurface of the heatsink 70 is the same as $d_1$ shown in FIG. 5A. The cam 25 of the push rod 24 and the second cams 37*a* and 37*b* of the second rod 36 make it possible to cause the heatsink 70 to move away from the upper surface of the card C parallel to this upper surface at the time of the insertion of the card C. Therefore, it is possible to reliably avoid the danger that the card C will interfere with the heatsink 70 when the card C is inserted.

Furthermore, when the card C is inserted into the position to contact the contacts of the header 11, the front end of the card C pushes the second end of the cam arm 21, so that the cam arm 21 pivots to retract the push rod 24 slightly. Along with this movement, the link 35 pivots to move the first end of the link 35 rearward and the second end forward, thus advancing the second rod 36 slightly. At this point, the cam roller 58*a* is still located on the first cam surface 26*a* of the cam part 25, and the cam rollers 58*b* and 58*c* are also still located on the respective first cam surfaces 38*aa* and 38*ba* of the second cams 37*a* and 37*b*. Therefore, the gap between the upper surface of the card C and the undersurface of the heatsink 70 is still the same as $d_1$. Accordingly, the card C does not interfere with the heatsink 70, so that the insertion of the card C is not hindered. Consequently, the heat conductive sheet 73 provided on the undersurface of the heatsink 70 does not come off during the insertion of the card C.

Next, when the card C is inserted into a position just in front of the header 11, the front end of the card C further pushes the second end of the cam arm 21, so that the cam arm 21 pivots to retract the push rod 24 further. Along with this movement, the link 35 further pivots to advance the second rod 36 further. At this point, the cam roller 58*a* is located at the boundary position between the first cam surface 26*a* and the second cam surface 26*b* of the cam 25, and the cam rollers 58*b* and 58*c* are also at the respective boundary positions between the first cam surfaces 38*aa* and 38*ba* and the second cam surfaces 38*ab* and 38*bb* of the second cams 37*a* and 37*b*. Therefore, the gap between the upper surface of the card C and the undersurface of the heatsink 70 is still $d_1$. Accordingly, the card C does not interfere with the heatsink 70, so that the insertion of the card C is not hindered. Consequently, the heat conductive sheet 73 provided on the undersurface of the heatsink 70 does not come off during the insertion of the card C.

Then, when the card C is completely inserted into the header 11, the front end of the card C further pushes the second end of the cam arm 21, so that the cam arm 21 pivots to further retract the push rod 24. Along with this movement, the link 35 further pivots to advance the second rod 36 further. At this point, the cam roller 58*a* is located in a position on the cam 25 toward the upper portion of the second cam surface 26*b* and engages, and the cam rollers 58*b* and 58*c* are also located in respective positions on the second cams 37*a* and 37*b* toward the upper portions of the second cam surfaces 38*ab* and 38*bb*. Therefore, the gap between the upper surface of the card C and the undersurface of the heatsink 70 is slightly reduced to be the same as $d_2$ shown in FIG. 5D.

Figure 10B:
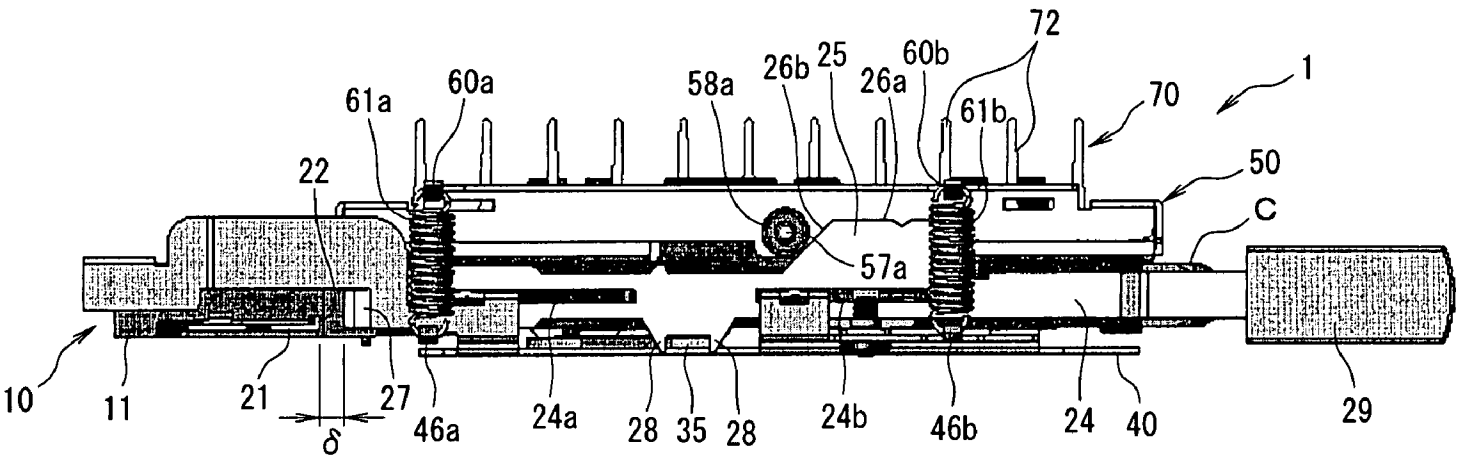
Figure 11B:
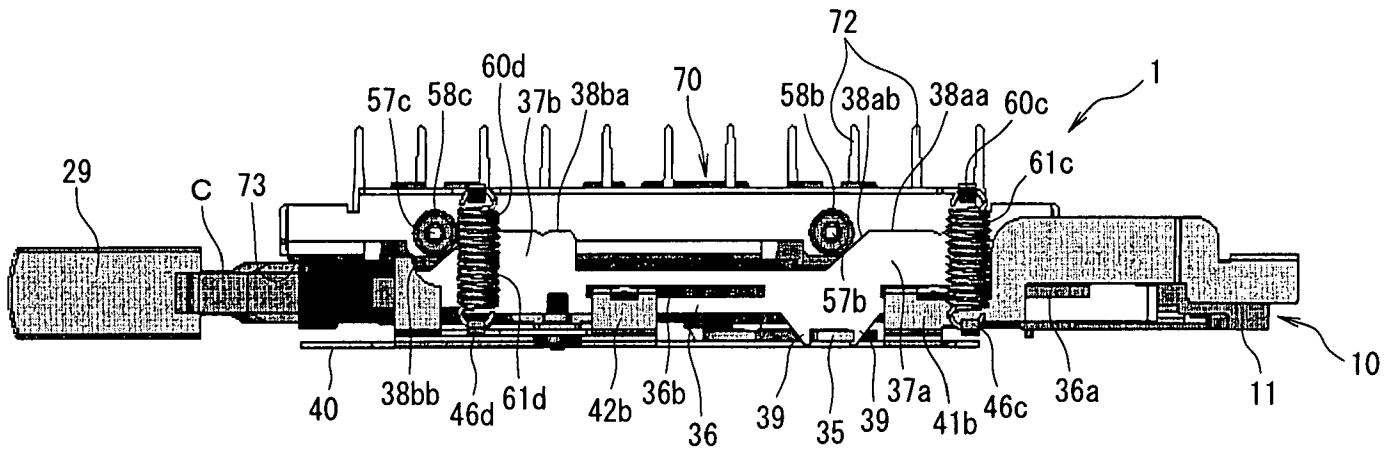

Subsequently, the upper frame 50 and heatsink 70 are lowered by the actions of the tension springs 61*a*, 61*b*, 61*c*, and 61*d*. Then, as is shown in FIG. 10B, the push rod 24 retracts via the second cam surface 26*b* with the lowering of the cam roller 58*a*, and as is shown in FIG. 11B, the second rod 36 advances via the second cam surfaces 38*ab* and 38*bb* with the lowering of the cam rollers 58*b* and 58*c*. As a result, the undersurface of the heatsink 70, or more accurately, the undersurface of the heat conductive sheet 73 pasted on the undersurface of the heatsink 70, contacts the surface of the card C. Because of this, heat dissipation of the card C can be performed. Consequently, it is possible to dissipate heat of the card C by means of the heatsink 70 without requiring any operation of the heatsink by the consumer.

Furthermore, as a result of the retraction of the push rod 24, a play □ is created between the front end 27 of the push rod 24 and the first end 22 of the cam arm 21 as shown in FIG. 10B. Accordingly, heat dissipation of the card C can be performed by the heatsink 70 only following the completion of the insertion of the card C into the header 11.

On the other hand, when the inserted card C is to be ejected, the push rod 24 is caused to advance from the state shown in FIG. 10B. Then, the cam roller 58*a* is raised along the second cam surface 26*b* of the push rod 24; furthermore, the second rod 36 retracts, and the cam rollers 58*b* and 58*c* are respectively raised along the second cam surfaces 38*ab* and 38*bb* of the second rod 36. As a result, the upper frame 50 and heatsink 70 rise. When the push rod 24 is pushed in until the front end 27 of this push rod 24 contacts the first end 22 of the cam arm 21, the gap between the upper surface of the card C and the undersurface of the heatsink 70 (or more accurately, the undersurface of the heat conductive sheet 73 provided on the undersurface of the heatsink 70) becomes the same as $d_2$ shown in FIG. 5D.

Then, when the push rod 24 is caused to advance further, the front end 27 of the push rod 24 pushes the first end 22 of the cam arm 21, so that the cam arm 21 pivots to retract the front end of the card C to a position just in front of the header 11. Along with this movement, the second rod retracts further. At this point, the cam roller 58*a* is raised along the second cam surface 26*b* of the push rod 24 and located at the boundary position between the first cam surface 26*a* and the second cam surface 26*b*; furthermore, the cam rollers 58*b* and 58*c* are also raised along the respective second cam surfaces 38*ab* and 38*bb* of the second rod 36 and located at the respective boundary positions between the first cam surfaces 38*aa* and 38*ba* and the second cam surfaces 38*ab* and 38*bb*. As a result, the gap between the upper surface of the card C and the undersurface of the heatsink 70 is increased to be the same as $d_1$ shown in FIG. 5C. Accordingly, the card C does not interfere with the heatsink 70, so that the ejection of the card C is not hindered. Consequently, the heat conductive sheet 73 provided on the undersurface of the heatsink 70 does not come off during the ejection of the card C.

Then, when the push rod 24 is caused to advance further, the front end 27 of the push rod 24 further pushes the first end 22 of the cam arm 21, so that the cam arm 21 pivots to retract the front end of the card C to a position where this front end contacts the tip ends of the contacts of the header 11. Along with this movement, the second rod 36 retracts further. At this point, the cam roller 58*a* is positioned on the first cam surface 26*a* of the cam part 25, and the cam rollers 58*b* and 58*c* are also positioned on the respective first cam surfaces 38*aa* and 38*ba* of the second cam parts 37*a* and 37*b*. Therefore, the gap between the upper surface of the card C and the undersurface of the heatsink 70 is maintained at $d_1$. Accordingly, the card C does not interfere with the heatsink 70, so that the ejection of the card C is not hindered. Consequently, the heat conductive sheet 73 provided on the undersurface of the heatsink 70 does not come off during the ejection of the card C.

Then, when the push rod 24 is caused to advance further, the push rod 24 assumes the most advanced position, and the front end 27 of the push rod 24 further pushes the first end 22 of the cam arm 21, so that the cam arm 21 pivots to retract the front end of the card C to a position where this front end is completely separated from the tip ends of the contacts of the header 11 as shown in FIG. 10A, thus ejecting the card C. Along with this movement, the second rod 36 also assumes the most retracted position as shown in FIG. 11A. In this state, the cam roller 58*a* is positioned on the first cam surface 26*a* of the cam 25, and the cam rollers 58*b* and 58*c* are also positioned on the respective first cam surfaces 38*aa* and 38*ba* of the second cams 37*a* and 37*b*. Therefore, the gap between the upper surface of the card C and the undersurface of the heatsink 70 is maintained at $d_1$. Accordingly, the card C does not interfere with the heatsink 70, so that the ejection of the card C is not hindered. Consequently, the heat conductive sheet 73 provided on the undersurface of the heatsink 70 does not come off during the ejection of the card C. Furthermore, there is no need for the consumer to perform any heatsink removal operation when ejecting the card C.

Here, by means of the cam part 25 of the push rod 24 and the second cam parts 37*a* and 37*b* of the second rod 36, the heatsink 70 can be caused to move away from the upper surface of the card C parallel to this upper surface during the ejection of the card C. Therefore, it is possible to reliably avoid the danger that the card C will interfere with the heatsink 70 when the card C is ejected.

Next, a third embodiment of the card connector of the present invention will be described with reference to FIGS. 12 through 14, 15A to 15E, and 16A to 16E. In FIGS. 12 through 14, 15A to 15E, and 16A to 16E, the card connector 1 comprises a connector part 10 into which a card C is inserted, and an ejection mechanism 20 which ejects the card C from the connector part 10.

Figure 12:
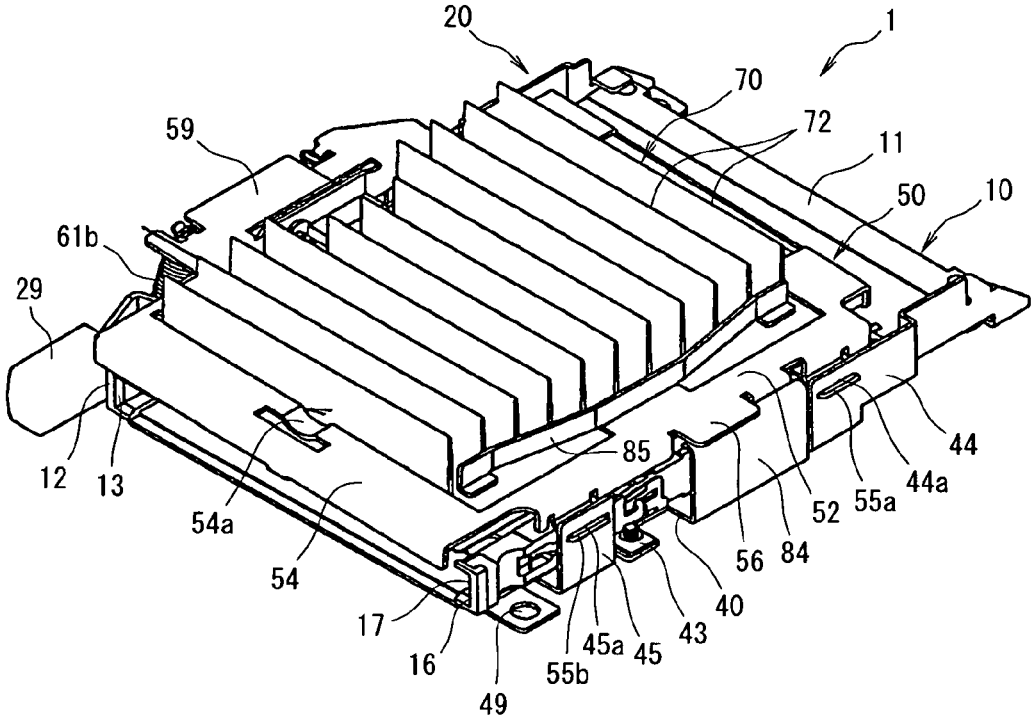
FIG. 12 is a perspective view of a card connector according to yet another exemplary embodiment of the present invention as seen from above obliquely on the right from the front side.
Figure 13:
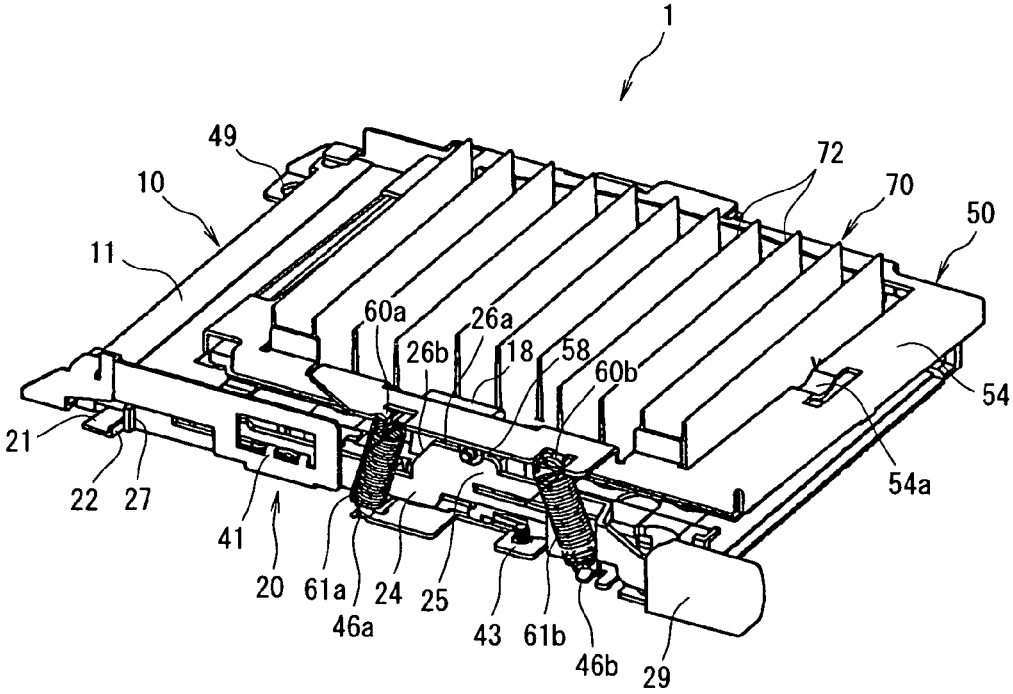
FIG. 13 is a perspective view of the card connector of FIG. 12 as seen from above obliquely on the left from the front side.
Figure 14:
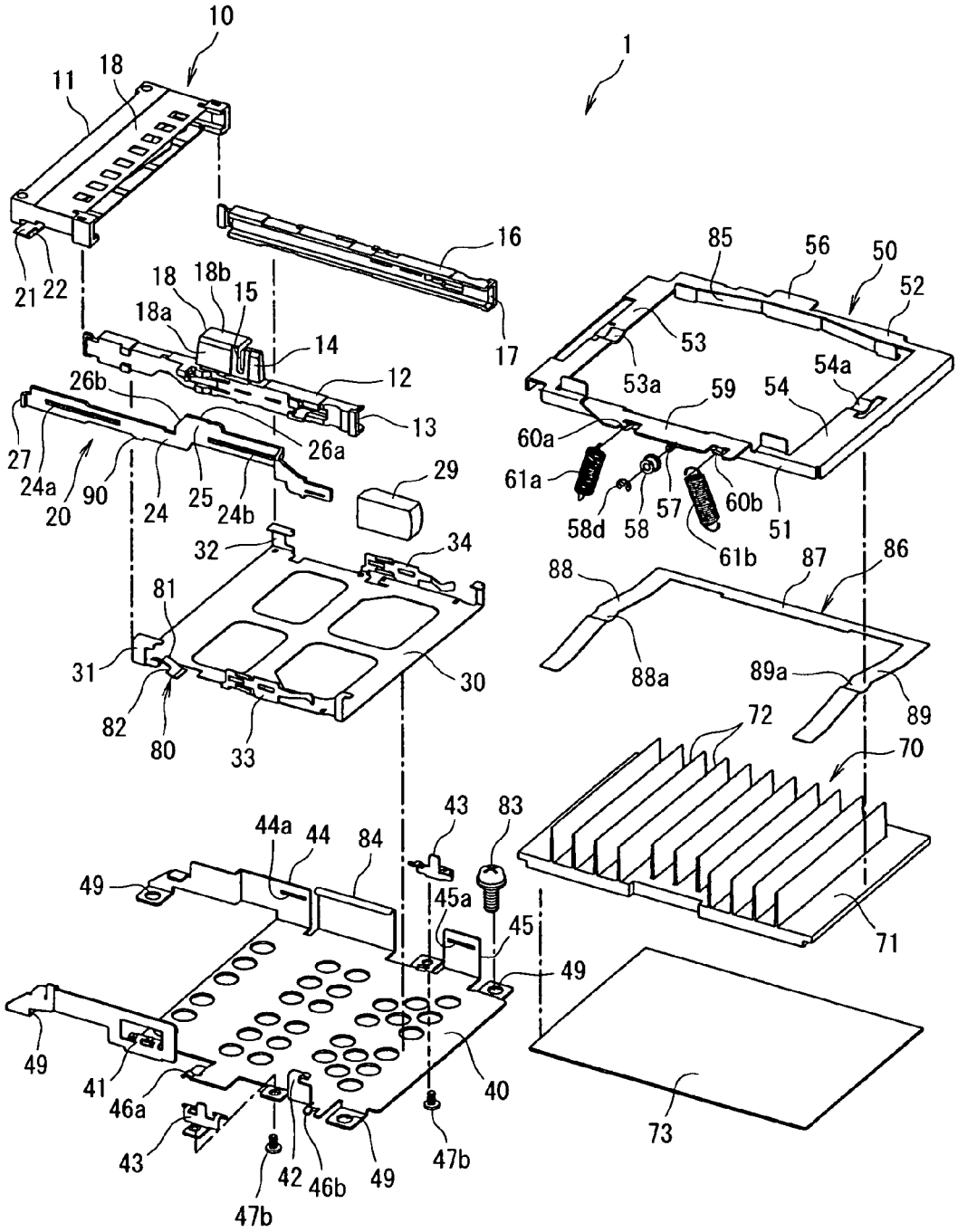
FIG. 14 is an exploded perspective view of the card connector shown in FIG. 12.

Between these parts, the connector part 10 comprises a header 11 into which the card C is inserted and which has a plurality of contacts (not shown in the figures) that are contacted by the contacts (not shown in the figures) of the card C, and a pair of guide arms 12 and 16 which extend rearward (downward in FIG. 12) from either side portion of the header 11 in the direction of width (left-right direction in FIG. 12). The respective guide arms 12 and 16 are press-fitted to either side portion of the header 11 in the direction of width in the front end portions of these guide arms. Furthermore, a ground plate 18 is disposed on the upper surface of the header 11.

A recessed guide 13 which guides the insertion of the card C is formed on the inside of the guide arm part 12 that is located on one side (left side in FIG. 12) of the header 11 in the direction of width, while a recessed guide 17 which guides the insertion of the card C is also formed on the inside of the guide arm part 16 that is located on the opposite side of the header 11 in the direction of width. Furthermore, a protruding part 14 protrudes from the upper surface of the guide arm 12 that is located on the first side described above substantially in the central portion in the forward-rearward direction, and a guide slit 15 that opens on the top is formed in this protruding part 14. In addition, unlike the card connector 1 shown in FIGS. 1A and 1B, a limiting part 18 which limits the upward movement of one side of a heatsink 70 when this heatsink 70 moves away from the upper surface of the card C is disposed in front of the protruding part 14 on the upper surface of the guide arm 12. The limiting part 18 is constructed from a riser 18*a* that rises from the upper surface of the guide arm 12 and a restricting piece 18*b* that extends inward from the riser 18*a* and that is positioned above the flange part 71 of the heatsink 70.

Moreover, a middle frame 30, which may be made of metal, is attached to the guide arm parts 12 and 16 so that this middle frame covers the lower portions of the pair of guide arms 12 and 16. Side walls 31 and 32 with a cross-sectional reverse C shape which rise from either side of the middle frame 30 in the direction of width and which are attached to the guide arms 12 and 16 are provided on the front end portions of the middle frame 30 on either side in the direction of width. Furthermore, side walls 33 and 34 which rise from either side of the middle frame 30 in the direction of width and which are positioned on the outside of the guide arms 12 and 16 are provided on either side of the middle frame 30 in the direction of width substantially in the central portion in the forward-rearward direction. In addition, a locking part 80 which locks the retraction of the push rod 24 when the card C is not inserted and which releases the locking of the push rod 24 by engaging with the card C during the insertion of the card C is provided on the edge portion of the middle frame 30 in the direction of width on the side of the guide arm 12 and behind the side wall 31. The locking part 80 comprises a releasing piece 81 which extends from the edge portion of the middle frame 30 in the direction of width on the side of the guide arm 12 and which releases the locking of the push rod 24 by engaging with the card C during the insertion of the card C, and a locking piece 82 which is continuous with the releasing piece 81 and which locks the retraction of the push rod 24 by engaging with a locking projection 90 on the push rod 24 when the card C is not inserted.

Furthermore, a lower frame 40, which may be made of metal, is installed so that this lower frame covers the lower portions of the header 11 and middle frame 30. A pair of brackets 43 are attached by attachment screws 47*b* to either side of the lower frame 40 in the direction of width substantially in the central portion in the forward-rearward direction. The lower frame 40 is attached to the middle frame 30 by these brackets 43 being attached to the side walls 33 and 34 of the middle frame 30 from the outside. Side wall guides 41 and 42 with a cross-sectional reverse C shape which rise from the lower frame 40 are respectively provided toward the front and toward the rear of the lower frame 40 on one side in the direction of width (on the side of the guide arm 12). Moreover, side wall supports 44 and 45 which rise from the lower frame 40 are respectively provided toward the front and toward the rear end of the lower frame 40 on the other side in the direction of width. Slits 44*a* and 45*a* that extend in the forward-rearward direction are formed in the respective side wall supports 44 and 45. In addition, a stopper 84 that rises from the lower frame 40 is disposed on the second side of the lower frame 40 in the direction of width and between the side wall supports 44 and 45. Furthermore, a spring locking part 46*a* is provided toward the front of the guiding side wall part 41 that is located on the first side of the lower frame 40 in the direction of width, and a separate spring locking part 46*b* is provided just in front of the side wall guide 42. Moreover, two pairs of attachment-screw holes 49 are formed in the front end and rear end of the lower frame 40 on either side in the direction of width, and the lower frame 40 is mounted on a circuit board (not shown in the figures) by screwing attachment screws 83 into these attachment-screw holes 49.

The ejection mechanism 20 comprises a cam arm 21 that is provided to the header 11 in a pivotable manner, and a push rod 24 that is provided on the outside of the guide arm 12 of the connector part 10.

The cam arm 21 is disposed on the header 11 so that this cam arm can pivot, with one end 22 being disposed on the side of the push rod 24 and the other end being disposed on the opposite side. Furthermore, this cam arm 21 is designed to eject the card C from the connector part 10 by pushing the front end portion of the inserted card C with the second end of the cam arm 21.

The push rod 24 has a first slit 24*a* that extends in the forward-rearward direction toward the front thereof and a second slit 24*b* that extends in the forward-rearward direction toward the rear thereof; as a result of these first and second slits 24*a* and 24*b* being respectively guided and supported by the side wall guides 41 and 42 of the lower frame 40, the push rod 24 can move linearly in the forward-rearward direction. The front end 27 of the push rod 24 is linked with the first end 22 of the cam arm 21, so that when the card C is inserted, the cam arm 21 pivots to retract the push rod 24, and when the push rod 24 advances, the cam arm 21 pivots to eject the card C. An operating part 29 is attached to the rear end of the push rod 24. Furthermore, a cam 25 stands on the upper surface of the push rod 24 substantially in the central portion in the forward-rearward direction. This cam 25 has on the upper surface thereof a first cam surface 26*a* which acts so that the heatsink 70 moves away from the upper surface of the card C at the time of the insertion of the card C; this cam 25 also has a second cam surface 26*b* which acts so that the heatsink 70 moves away from the surface of the card C during the ejection of the card C. The second cam surface 26*b* is formed by making the front end surface of the cam 25 an inclined surface. Moreover, the locking projection 90 is provided at the bottom of the push rod 24.

The heatsink 70 which contacts the upper surface of the card C that is inserted into the header 11 is provided above the pair of guide arm parts 12 and 16. This heatsink 70 is formed as a substantially rectangular body having a plurality of heat-radiating projections 72 on the upper surface, and has the flange 71 around the circumference thereof. A heat conductive sheet 73 is pasted on the undersurface of the heatsink 70. The heatsink 70 is supported by an upper frame 50 that is shaft-supported on the lower frame 40 so that this upper frame 50 can pivot in the vertical direction.

The upper frame 50 is a hollow frame body, and comprises a front frame part 53, a rear frame part 54, a right frame part 52 that connects the right side of the front frame part 53 and the right side of the rear frame part 54 (right side in FIG. 12), and a left frame part 51 that connects the left side of the front frame part 53 and the left side of the rear frame part 54, with these frame parts having a cross-sectional L shape. Supporting bent parts 53*a* and 54*a* that are bent so as to protrude downward are respectively formed on the upper wall of the front frame part 53 and on the upper wall of the rear frame part 54 in the central portions of these frame parts in the direction of width. Supporting pieces 53*b* and 54*b* (only 54*b* is shown, see FIG. 15A) that respectively face the supporting bent parts 53*a* and 54*a* are formed on the respective undersurfaces of the front frame part 53 and rear frame part 54 substantially in the central portions of these frame parts in the direction of width. The flange part 71 of the heatsink 70 is disposed between the supporting bent parts 53*a* and 54*a* of the front frame part 53 and rear frame part 54, and the supporting pieces 53*b* and 54*b* of the front frame part 53 and rear frame part 54, so that the heatsink 70 is supported by the upper frame 50 in a pivotable manner in the vertical direction with the supporting bent parts 53*a* and 54*a* as substantial center points. An elastic metal piece 86 is disposed between the flange part 71 of the heatsink 70 and the respective upper walls of the front frame part 53, rear frame part 54, and right frame part 52. This elastic metal piece 86 is formed in a reverse C shape comprising a rectilinear part 87 that is positioned beneath the upper wall of the right frame part 52, and arm parts 88 and 89 that respectively extend from the front end and rear end of the rectilinear part 87 underneath the upper wall of the front frame part 53 and the upper wall of the rear frame part 54. Bent parts 88*a* and 89*a* that have a downward convex shape corresponding to the supporting bent parts 53*a* and 54*a* are formed on the respective arm parts 88 and 89. As a result of the elastic metal piece 86 being disposed between the flange part 71 of the heatsink 70 and the respective upper walls of the front frame part 53, rear frame part 54, and right frame part 52 by causing these bent parts 88*a* and 89*a* to respectively face the undersurfaces of the supporting bent parts 53*a* and 54*a*, the vertical wobbling of the flange part 71 in the vicinity of the supporting bent parts 53*a* and 54*a* is prevented. Furthermore, the right frame part 52 of the upper frame 50 is provided with a spring part (spring means) 85 which drives the flange part 71 of the heatsink 70 on the side of the guide arm part 12 toward the limiting part 18 by pressing the heat-radiating projections 72 of the heatsink 70 that is supported by the upper frame 50. The right frame part 52 of the upper frame 50 is also provided with pivoting supporting parts 55*a* and 55*b* which support the upper frame 50 in a pivotable manner by respectively entering the slits 44*a* and 45*a* in the supporting side wall parts 44 and 45 that are provided on the lower frame 40. Furthermore, the left frame part 51 of the upper frame 50 is provided with a tongue part 59 that is bent outward from the upper surface of this left frame part, and spring locking parts 60*a* and 60*b* are provided toward the front and toward the rear of the tongue part 59. Moreover, a supporting shaft 57 is fastened to the left frame part 51 of the upper frame 50, and a cam roller 58 is shaft-supported around the outer circumference of this supporting shaft 57 on the outside portion of the left frame part 51 so that this cam roller can rotate by means of a C ring 58*d*.

Figure 15A:
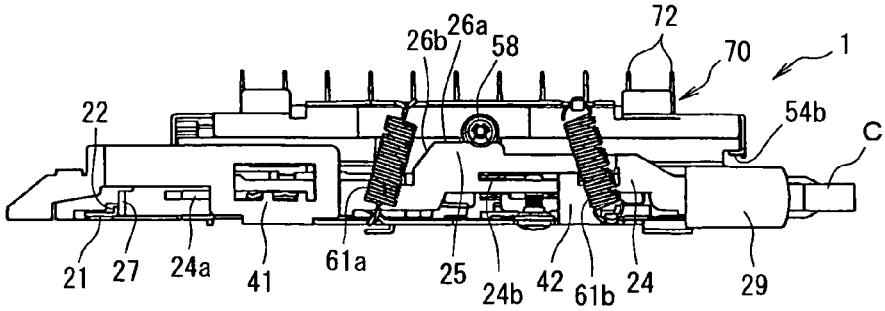
FIGS. 15A to 15E are lest-side views of the connector of FIG. 12 showing the relationship between the insertion position of a card with respect to the header, the vertical position of a heatsink with respect to the card, and the position of a push rod in the forward-rearward direction with respect to a cam arm.

Tension springs (spring means) 61*a* and 61*b* cause the upper frame 50 to pivot downward with the pivoting supporting parts 55*a* and 55*b* as substantial center points. Hook parts on the tension springs 61*a* and 61*b* are respectively engaged with the spring locking parts 46*a* and 46*b* of the lower frame 40 and the spring locking parts 60*a* and 60*b* of the upper frame 50. As a result, the heatsink 70 that is supported by the upper frame 50 also pivots downward. In this case, the downward movement is accomplished by the portion of the supporting shaft 57 on the inside of the upper frame 50 being guided by the guide slit 15 formed in the guide arm 12. Thus, when the card C is inserted in the header 11, the heat conductive sheet 73 on the undersurface of the heatsink 70 contacts the upper surface of the card C. However, when the card C is not inserted in the header 11, as is shown in FIG. 15A, the cam roller 58 is positioned on the first cam surface 26*a* of the cam 25, so that a space for allowing the insertion of the card C is assured. Furthermore, a stopper piece 56 that protrudes to the outside is formed on the right frame part 52 of the upper frame 50, and as a result of this stopper piece 56 contacting the upper surface of the stopper 84 of the lower frame 40, the downward pivoting of the right frame part 52 of the upper frame 50 is restricted.

Next, the actions accompanying the insertion and ejection of the card C will be described with reference to FIGS. 15A to 15E, and 16A to 16E.

Figure 16A:
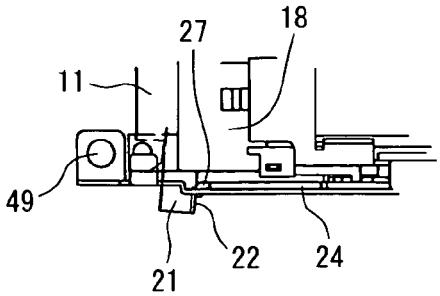
FIGS. 16A to 16E are serial plan views of the connector of FIG. 12 corresponding to FIGS. 15A to 15E, showing the position of the push rod in the forward-rearward direction with respect to the cam arm.

First, as is shown in FIGS. 15A and 16A, when the card C is not inserted, the push rod 24 is in the most advanced position, and in the position which is such that the front end 27 of the push rod 24 contacts the first end 22 of the cam arm 21, and that the second end of the cam arm 21 is most retracted. In this state, the cam roller 58 is positioned on top of the first cam surface 26*a* of the cam 25, and a space is assured which is such that the gap between the upper surface of the card C and the undersurface of the heatsink 70 is the same as $d_1$ shown in FIG. 5A.

Figure 15B:
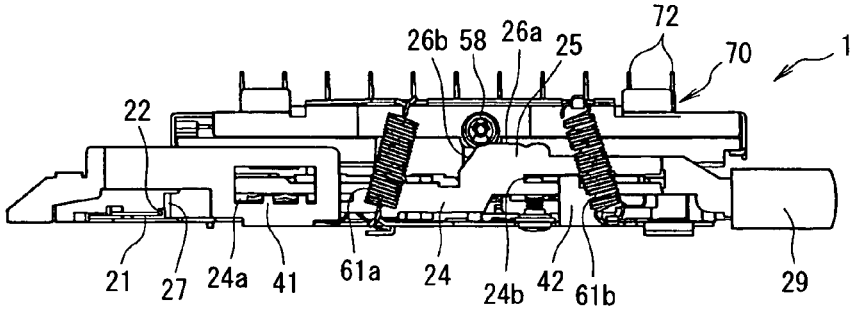
Figure 16B:
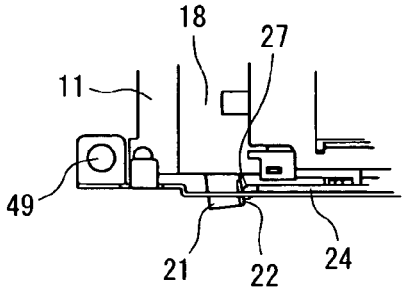

When the card C is inserted into the position to contact the contacts of the header 11, the front end of the card C pushes the second end of the cam arm 21, so that the cam arm 21 pivots to retract the push rod 24 slightly as shown in FIGS. 15B and 16B. At this point, the cam roller 58 is still located on the first cam surface 26*a* of the cam 25, so that the gap between the upper surface of the card C and the undersurface of the heatsink 70 is still the same as $d_1$. Accordingly, the card C does not interfere with the heatsink 70, so that the insertion of the card C is not hindered. Consequently, the heat conductive sheet 73 provided on the undersurface of the heatsink 70 does not come off during the insertion of the card C.

Figure 15C:
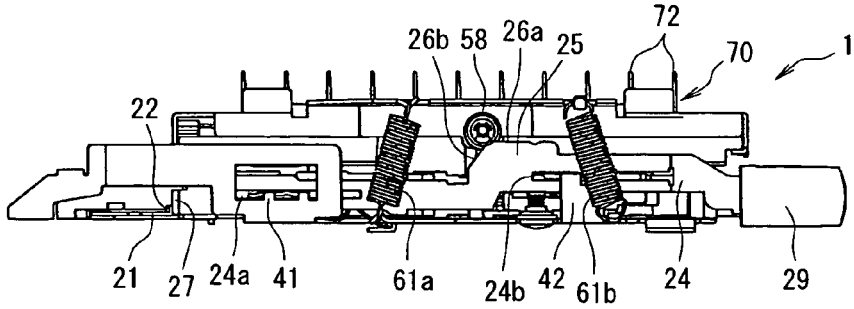
Figure 16C:
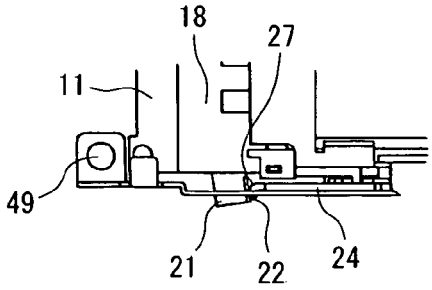

Next, when the card C is inserted into a position just in front of the header 11, the front end of the card C further pushes the second end of the cam arm 21, so that the cam arm 21 pivots to retract the push rod 24 further as shown in FIGS. 15C and 16C. At this point, the cam roller 58 is located at the boundary position between the first cam surface 26*a* and the second cam surface 26*b* of the cam 25, and the gap between the upper surface of the card C and the undersurface of the heatsink 70 is still the same as $d_1$. Accordingly, the card C does not interfere with the heatsink 70, so that the insertion of the card C is not hindered.

Consequently, the heat conductive sheet 73 provided on the undersurface of the heatsink 70 does not come off during the insertion of the card C.

Figure 15D:
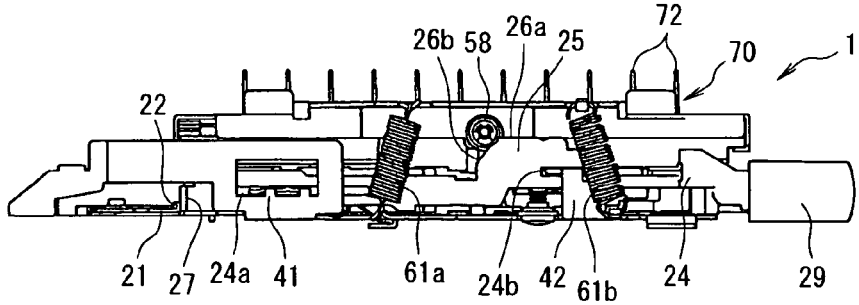
Figure 16D:
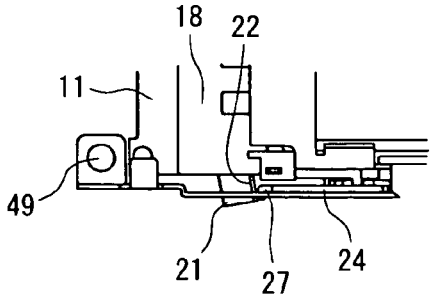

Then, when the card C is completely inserted into the header 11, the front end of the card C further pushes the second end of the cam arm 21, so that the cam arm 21 pivots to retract the push rod 24 further as shown in FIGS. 15D and 16D. At this point, the cam roller 58 is located in a position on the cam 25 toward the upper portion of the second cam surface 26*b* and engages, so that the gap between the upper surface of the card C and the undersurface of the heatsink 70 is slightly reduced to be the same as $d_2$ shown in FIG. 5D.

Figure 15E:
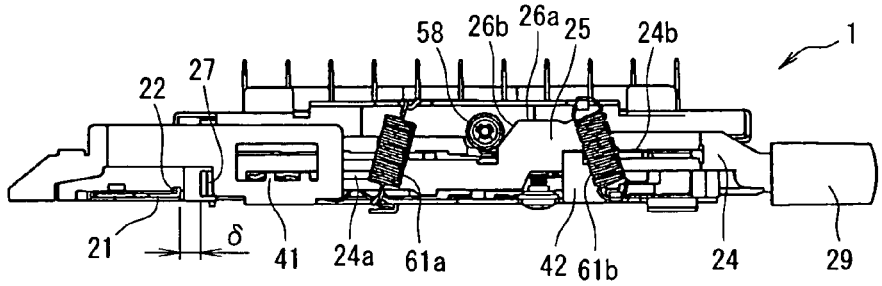
Figure 16E:
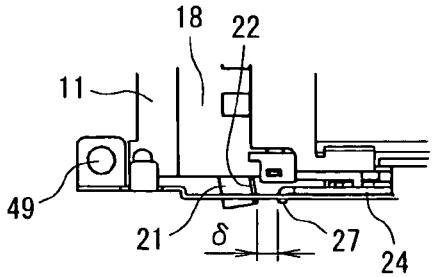
Figure 17:
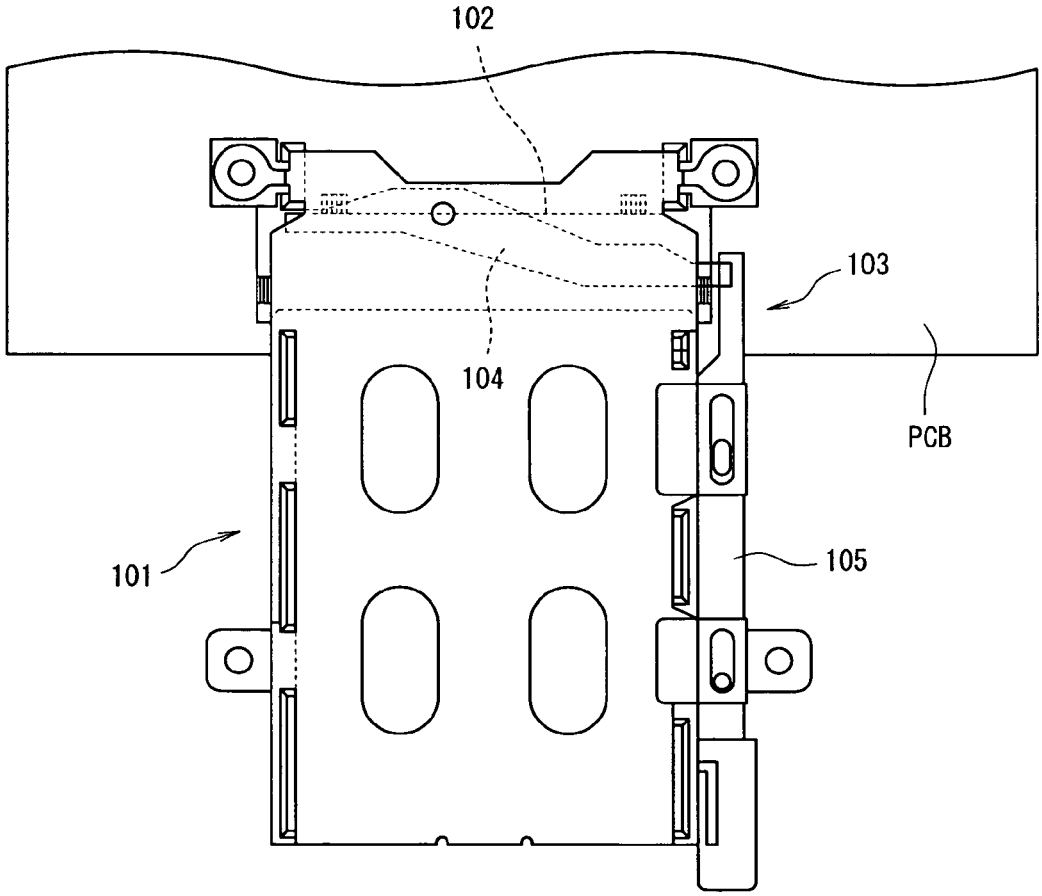
FIG. 17 is a plan view of a conventional example of a card connector.
Figure 18:
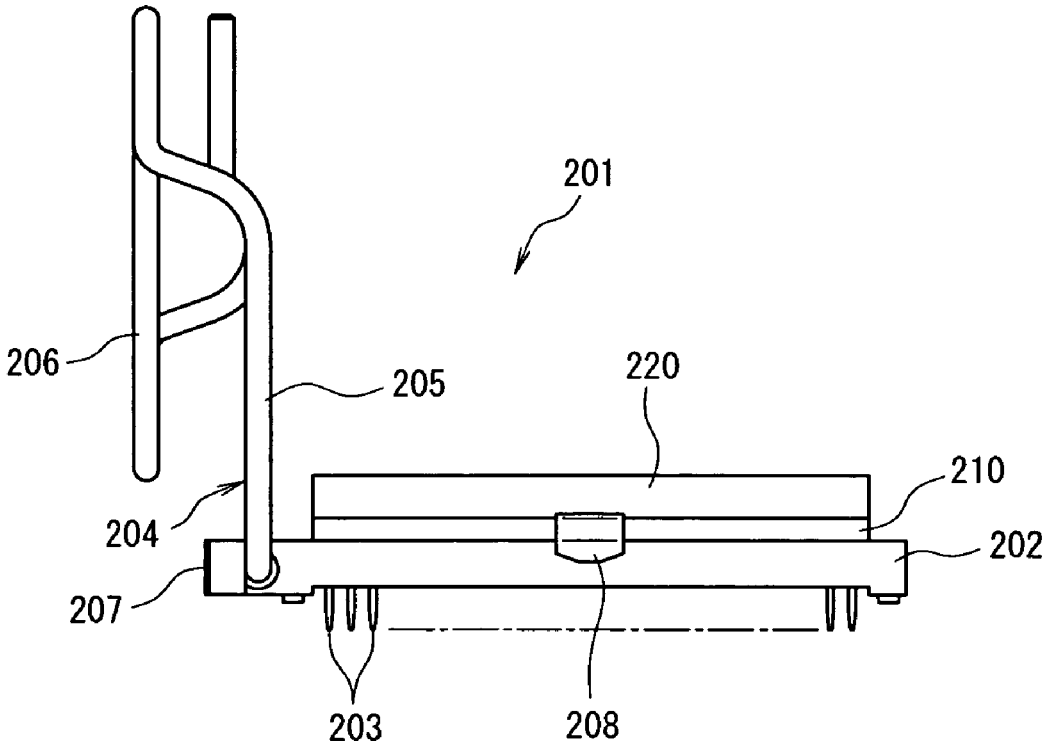
FIG. 18 is a front view of a conventional IC socket.

Afterward, as is shown in FIGS. 15E and 16E, the upper frame 50 and heatsink 70 pivot downward by means of the actions of the tension springs 61*a* and 61*b*, and only the push rod 24 retracts via the second cam surface 26*b* with the lowering of the cam roller 58. Therefore, the undersurface of the heatsink 70, or more accurately, the undersurface of the heat conductive sheet 73 pasted on the undersurface of the heatsink 70, contacts the surface of the card C. As a result, heat dissipation of the card C can be performed. Consequently, it is possible to dissipate heat of the card C by means of the heatsink 70 without requiring any operation of the heatsink by the consumer.

Furthermore, since only the push rod 24 retracts, a play □ is created between the front end 27 of the push rod 24 and the first end 22 of the cam arm 21 as shown in FIGS. 15E and 16E. Accordingly, heat dissipation of the card C can be performed by the heatsink 70 only following the completion of the insertion of the card C into the header 11.

On the other hand, when the inserted card C is to be ejected, the push rod 24 is caused to advance from the state shown in FIGS. 15E and 16E. Then, the cam roller 58 is raised along the second cam surface 26*b* of the push rod 24, so that the upper frame 50 and heatsink 70 pivot upward. When the push rod 24 is pushed in until the front end 27 of this push rod 24 contacts the first end 22 of the cam arm 21 as shown in FIGS. 15D and 16D, the gap between the upper surface of the card C and the undersurface of the heatsink 70 (or more accurately, the undersurface of the heat conductive sheet 73 provided on the undersurface of the heatsink 70) becomes the same as $d_2$ shown in FIG. 5D. In the process from the state shown in FIG. 15E to the state shown in FIG. 15D, since the play □ is present between the front end 27 of the push rod 24 and the first end 22 of the cam arm 21 in the state shown in FIG. 15E, the front end 27 of the push rod 24 does not contact the first end 22 of the cam arm 21. Therefore, the heatsink 70 does not move away from the upper surface of the card C.

Then, when the push rod 24 is caused to advance from the state shown in FIGS. 15D and 16D to the state shown in FIGS. 15C and 16C, the front end 27 of the push rod 24 pushes the first end 22 of the cam arm 21, so that the cam arm 21 pivots to retract the front end of the card C to a position just in front of the header 11. At this point, the cam roller 58 is raised along the second cam surface 26*b* of the push rod 24 and located at the boundary position between the first cam surface 26*a* and the second cam surface 26*b*. As a result, the gap between the upper surface of the card C and the undersurface of the heatsink 70 is increased to be the same as $d_1$ shown in FIG. 5C. Accordingly, the card C does not interfere with the heatsink 70, so that the ejection of the card C is not hindered. Consequently, the heat conductive sheet 73 provided on the undersurface of the heatsink 70 does not come off during the ejection of the card C.

Then, when the push rod 24 is caused to advance from the state shown in FIGS. 15C and 16C to the state shown in FIGS. 15B and 16B, the front end 27 of the push rod 24 further pushes the first end 22 of the cam arm 21, so that the cam arm 21 pivots to retract the front end of the card C to a position where this front end contacts the tip ends of the contacts of the header 11. At this point, the cam roller 58 is positioned on the first cam surface 26*a* of the cam part 25, and the gap between the upper surface of the card C and the undersurface of the heatsink 70 is maintained at $d_1$. Accordingly, the card C does not interfere with the heatsink 70, so that the ejection of the card C is not hindered. Consequently, the heat conductive sheet 73 provided on the undersurface of the heatsink 70 does not come off during the ejection of the card C.

Then, when the push rod 24 is caused to advance from the state shown in FIGS. 15B and 16B to the state shown in FIGS. 15A and 16A, the push rod 24 assumes the most advanced position, and the front end 27 of the push rod 24 further pushes the first end 22 of the cam arm 21, so that the cam arm 21 pivots to retract the front end of the card C to a position where this front end is completely separated from the tip ends of the contacts of the header 11, thus ejecting the card C. In this state, the cam roller 58 is positioned on the first cam surface 26*a* of the cam 25, and the gap between the upper surface of the card C and the undersurface of the heatsink 70 is maintained at $d_1$. Accordingly, the card C does not interfere with the heatsink 70, so that the ejection of the card C is not hindered. Consequently, the heat conductive sheet 73 provided on the undersurface of the heatsink 70 does not come off during the ejection of the card C. Moreover, it is not necessary for the consumer to perform any heatsink removal operation when ejecting the card C.

Furthermore, since a limiting part 18 is provided which limits the upward movement of one side of the heatsink 70 (on the side of the guide arm part 12) when the heatsink 70 moves away from the upper surface of the card C, even though the heatsink 70 is supported by the upper frame 50 so that this heatsink can pivot upward and downward, the heatsink 70 can be kept more or less horizontally when the heatsink 70 moves away from the card C.

Moreover, since the upper frame 50 is provided with a spring part 85 which drives one side of the heatsink 70 (on the side of the guide arm part 12) toward the limiting part 18, this side of the heatsink 70 can be positioned at the limiting part 18 when the heatsink 70 moves away from the card C, so that the heatsink 70 can be securely kept more or less horizontally.

In addition, since the middle frame 30 is provided with a locking part 80 which locks the retraction of the push rod 24 when the card C is not inserted and which releases the locking of the push rod 24 by engaging with the card C during the insertion of the card C, even if the push rod 24 is pulled by mistake when the card C is not inserted, the retraction of this push rod can be blocked, so that the movement of the heatsink 70 toward the card C can be stopped.

Embodiments of the present invention were described above. However, the present invention is not limited to these embodiments; various alterations or modifications can be made.

For example, not only is the push rod 24 of the ejection mechanism 20 provided on the outside of the guide arm 12 of the connector part 10, but this push rod 24 can also be provided on the outside of the opposite-side guide arm 16.

What is claimed is:

1. A card connector comprising:

a connector part into which a card is inserted; and an ejection mechanism which ejects the card from the connector part, the ejection mechanism having a cam arm that is provided to the connector part in a pivotable manner and that ejects the card from the connector part, and a push rod that is provided on one side of the connector part and that is linked with the cam arm so that the push rod can move linearly in the forward-rearward direction;

the cam arm pivoting to retract the push rod during the insertion of the card, and the cam arm pivoting to eject the card when the push rod advances;

wherein the card connector further comprises a heatsink for contacting one surface of the card that is inserted into the connector part, and spring means for driving the heatsink toward the one surface of the card;

the push rod has a cam having a first cam surface which acts so that the heatsink moves away from the one surface of the card at the time of the insertion of the card, and a second cam surface which acts so that the heatsink moves toward the one surface of the card during the ejection of the card.

2. The card connector according to claim 1, wherein the cam arm pivots to retract the push rod during the insertion of the card, and following the completion of the insertion of the card, the heatsink engages with the second cam surface of the cam part and contacts the one surface of the card, and play is created between the push rod and the cam arm.

3. The card connector according to claim 1, wherein the heatsink is supported by an upper frame that is shaft-supported by a lower frame of the card connector so that the upper frame can pivot in the vertical direction.

4. The card connector according to claim 1, further comprising:

a second rod that can move linearly in the forward-rearward direction being provided on the side of the connector part opposite from the side on which the push rod is provided, the second rod has a second cam having a first cam surface which acts so that the heatsink moves away from the one surface of the card at the time of the insertion of the card, and a second cam surface which acts so that the heatsink moves away from the one surface of the card during the ejection of the card; and a link that connects the push rod and the second rod.

5. The card connector according to claim 1, wherein a locking part is present which locks the retraction of the push rod when the card is not inserted and which releases the locking of the push rod by engaging with the card during the insertion of the card.

6. The card connector according to claim 3, wherein the heatsink is supported by the upper frame so that the heatsink can pivot in the vertical direction.

7. The card connector according to claim 4, wherein a limiting part is provided which limits the upward movement of one side of the heatsink when the heatsink moves away from the one surface of the card.

8. The card connector according to claim 6, wherein the upper frame is provided with spring means for driving one side of the heatsink toward the limiting part.

* * * * *